US005993174A

United States Patent [19]

Konishi

[11] Patent Number: 5,993,174

[45] Date of Patent: Nov. 30, 1999

[54] PULSATION FREE PUMP

[75] Inventor: Yoshiaki Konishi, Higashimurayama, Japan

[73] Assignee: Nikkiso Co., Ltd., Tokyo, Japan

[21] Appl. No.: 08/751,715

[22] Filed: Nov. 18, 1996

Related U.S. Application Data

[63] Continuation-in-part of application No. 08/518,367, Aug. 23, 1995, abandoned.

[30] Foreign Application Priority Data

Aug. 23, 1994 [JP] Japan ..... 6-198744
Aug. 21, 1995 [JP] Japan ..... 7-211515

[51] Int. Cl.[6] ..... F04B 17/00

[52] U.S. Cl. ..... 417/413.1; 417/415; 417/521

[58] Field of Search ..... 417/413.1, 415, 417/486, 504, 502, 503, 521, 221, 222.1; 92/71, 138

[56] References Cited

U.S. PATENT DOCUMENTS

| | | | |
|---|---|---|---|
| 4,089,624 | 5/1978 | Nichols et al. | 417/362 |
| 4,453,898 | 6/1984 | Leka et al. | 417/521 |
| 4,734,187 | 3/1988 | Visentin et al. | 210/101 |
| 4,830,589 | 5/1989 | Pareja | 417/539 |
| 4,848,606 | 7/1989 | Taguchi et al. | 222/333 |
| 4,924,722 | 5/1990 | Bacardit et al. | 74/459 |
| 5,011,377 | 4/1991 | Sagawa et al. | 417/269 |
| 5,145,339 | 9/1992 | Lehrke et al. | 417/521 |

*Primary Examiner*—Timothy S. Thorpe
*Assistant Examiner*—Ehud Gartenberg
*Attorney, Agent, or Firm*—Young & Thompson

[57] ABSTRACT

The invention provides a pulsation free pump which includes a plurality of hydraulic diaphragm pumps, a plurality of plungers corresponding to the hydraulic diaphragm pumps, each of the plungers performing a reciprocal movement which provides a pumping cycle operation of corresponding one of the plurality of hydraulic diaphragm pumps and an adjustable exhaust differential pressure regulating valve. Each of the pumping cycles includes a discharge process and a subsequent suction process. A controller is provided for controlling reciprocal movements of the plungers in association with each other at a predetermined difference in phase of the pumping cycle. The controller controls the reciprocal movement of each of the plungers so as to set a preliminary pressure-rising process just before the discharge process so that a discharge flow rate of each of the diaphragm pumps is initiated to increase without any time delay when the pumping cycle enters into the discharge process so that a total discharge flow rate defined by the sum of the discharge flow rates of all of the plungers is kept constant and free of any substantial pulsation.

15 Claims, 20 Drawing Sheets

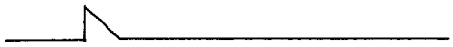
FIG. 9A
PRIOR ART
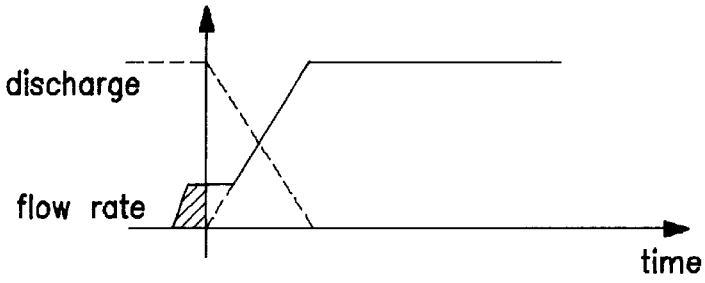
FIG. 9B
PRIOR ART
FIG. 10A
PRIOR ART
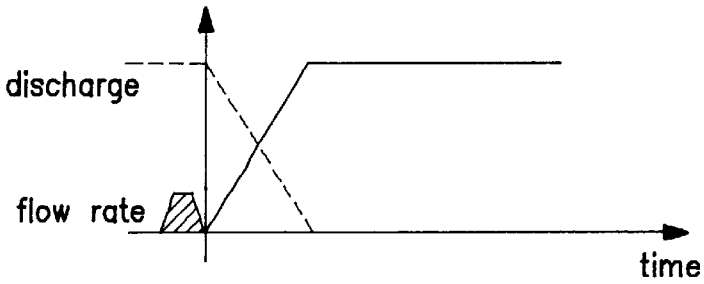
FIG. 10B
PRIOR ART

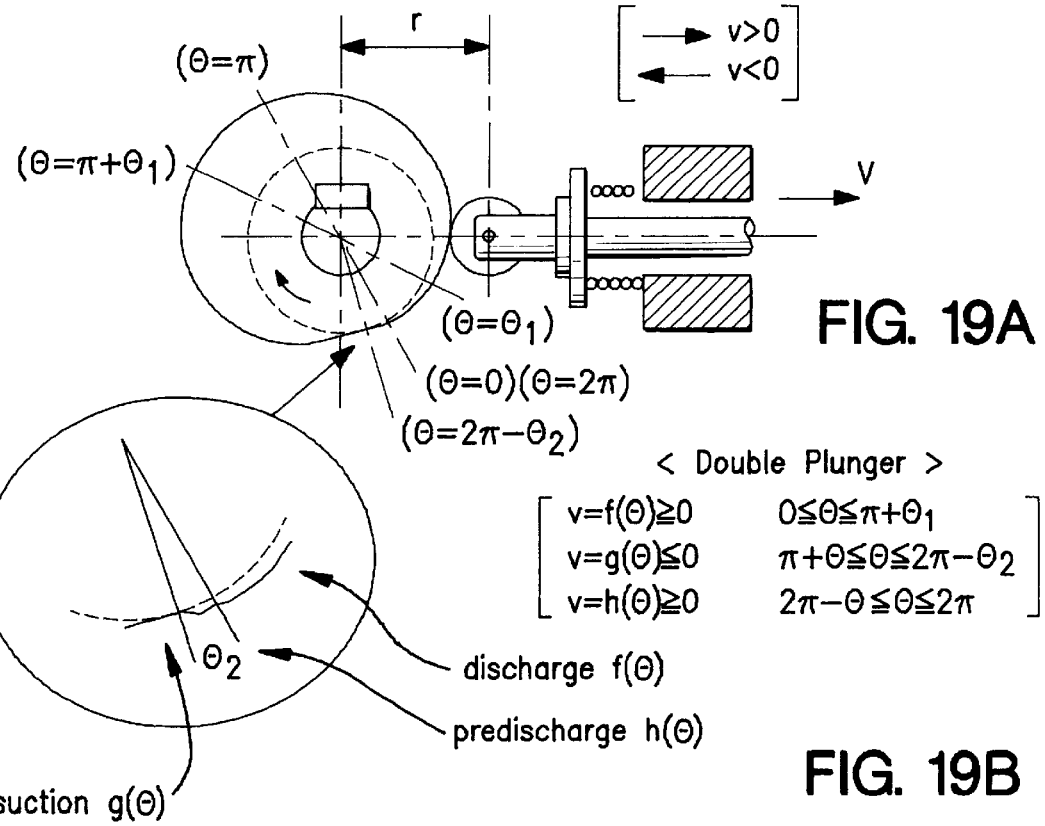
FIG. 19A
FIG. 19B
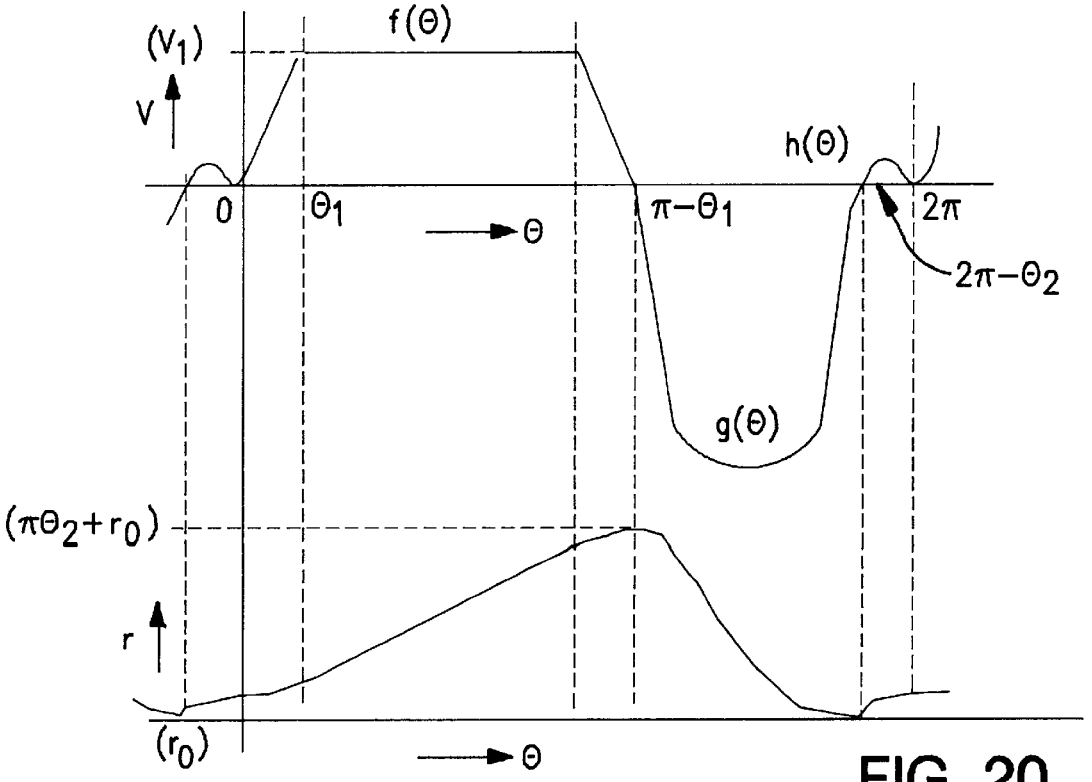
FIG. 20

PULSATION FREE PUMP

This application is a Continuation In Part of Ser. No. 08/518,367 filed Aug. 23, 1995 abandoned.

BACKGROUND OF THE INVENTION

The present invention relates to an automatic air extraction hydraulic diaphragm pump driven by a cam mechanism, and more particularly to a pulsation free pump provided with a pulsation adjustable feature capable of adjusting variable pulsation of a pump discharge liquid to be minimum during operations of the pumps.

Twin pulsation free pumps are illustrated in FIGS. 1A and 1B and have generally been known. In FIG. 1A, two automatic air extraction hydraulic diaphragm pumps P1 and P2 are arranged in parallel to each other to be driven by a cam mechanism 10 at a phase difference of 180°. In FIG. 1B, two automatic air extraction hydraulic diaphragm pumps P1 and P2 are arranged in series to be driven by a cam mechanism 10 at a phase difference of 180°. The first and second pumps P1 and P2 have pump chambers 12, 12 which are coupled to a single suction inlet pipe 14 and to a discharge pipe 16. The first and second pumps P1 and P2 also have hydraulic chambers 18, 18 which are coupled through automatic air extractors 20, 20 to oil reservoirs 22, 22.

Similarly, triple pulsation free pumps may be constituted by three automatic air extraction hydraulic diaphragm pumps driven by a cam mechanism at a phase difference of 120°.

FIG. 2A is illustrative of a property in a theoretical discharge flow rate of the above twin pulsation free pumps. FIG. 2B is illustrative of a property in an actual composite discharge flow rate of the above twin pulsation free pumps. FIG. 3A is illustrative of a property in a theoretical discharge flow rate of the above triple pulsation free pumps. FIG. 3B is illustrative of a property in an actual composite a discharge flow rate of the above triple pulsation free pumps.

The conventional pulsation free pumps described above, however, exhibit undesirable pulsation discharge flows due to the following five factors.

The first factor is concerned with a clearance in the driving section. The second factor is concerned with a residual air in a hydraulic driving section. The third factor is concerned with a leakage of the liquid in an air extraction process. The fourth factor is concerned with a residual air in a pump operation section. The fifth factor is concerned with a leakage of the liquid from a check valve. Due to the above factors, the first pump P1 positioned to follow the second pump P2 shows a delay ($\Delta t$) in time of the discharge as well as a loss ($\Delta q$) of the discharge flow rate. The following descriptions will focus on each of the influences caused by the above five factors.

As to the first factor concerned with the clearance in the driving section, even if a clearance exists in a rotation driving section, no change in the discharge flow rate appears due to the clearance being unidirectional. If, however, a clearance exists in a reciprocal driving section then the direction of the clearance is different between the discharge and suction processes thereby a waveform of the actual discharge flow rate of the first pump P1 is shifted from the theoretical waveform thereof in a direction of delay as illustrated in FIG. 4A. Particularly, the clearance direction is changed at a time $\theta_3$ when the first pump P1 enters into a suction process. As a result, the composite discharge flow rate is reduced at a time when the first pump P1 initiates the discharge as well as increased at a time when the first pump P1 initiates the suction and the second pump P2 initiates the discharge as illustrated in FIG. 4B.

As to the second factor concerned with the influences of the residual air in the hydraulic driving section, at a time $\theta_0$ when the first pump P1 enters into the suction process, an air pressure is raised thereby causing an undesirable and additional time consumption for obtaining the required discharge pressure. An increase of the discharge flow rate of the first pump P1 has a time delay ($\Delta t$1) as illustrated in FIG. 5A. The composite discharge flow rate has a certain loss ($\Delta q$1) of the discharge flow rate as illustrated in FIG. 5B.

As to the third factor concerned with the leakage of the liquid in the air extraction process, at the time $\theta_0$ when the first pump P1 enters into the discharge process, a small amount of the oil liquid is unwillingly extracted from the hydraulic driving section during air extraction. Such oil leakage leads to an undesirable and additional time consumption for obtaining the required discharge pressure of the first pump P1 thereby an increase of the discharge flow rate has a time delay ($\Delta t$2) as illustrated in FIG. 6A. As a result, the composite discharge flow rate has a certain loss ($\Delta q$1) of the discharge at the time when the first pump P1 initiates the discharge as illustrated in FIG. 6B.

As to the fourth factor concerned with the influences by the residual air in the pump operation section, at the time $\theta_0$ when the first pump P1 enters into the discharge process, an air pressure is raised thereby causing an undesirable and additional time consumption for obtaining the required discharge pressure. An increase of the discharge flow rate of the first pump P1 has a time delay (t1) as illustrated in FIG. 5A. The composite discharge flow rate has a certain loss ($\Delta q$1) of the discharge flow rate as illustrated in FIG. 5B.

As to the fifth factor concerned with the influences due to the leakage of the liquid from the check valve, when a leakage of the liquid is generated from the check valve positioned at the discharge side of the first pump P1, then during the discharge process of the first pump P1 there appears a leakage of the discharge liquid from the inside of the first pump P1 into the suction inlet pipe thereby the discharge flow rate of the first pump P1 is totally reduced as illustrated in FIG. 7A. As a result, the composite discharge flow rate is reduced from the theoretical discharge flow rate during the discharge process of the first pump P1 as illustrated in FIG. 7B.

When a leakage of the liquid is generated at the check valve positioned at the suction side of the first pump P1, then during the discharge process of the first pump P1, the discharge liquid flows during the discharge process of the first pump P1 in a reverse direction from the discharge pipe into the inside of the first pump P1 thereby a suction flow rate of the first pump p1 is totally reduced as illustrated in FIG. 7C. As a result, the composite discharge flow rate is reduced from the theoretical discharge flow rate during the suction process of the first pump P1 namely during the discharge process of the second pump P2 as illustrated in FIG. 7D.

The above problems caused by the first and fifth factors may readily be settled by a certain design change of pump elements, whereas settlements of the problems caused by the remaining factors, namely, the second, third and fourth factors would be difficult. There has been proposed a compensation of cams in the cam mechanism 10 for settlements of the above problems due to the above second, third and fourth factors. The compensations already proposed may be classified into three types as follows.

The first proposal is to compensate the cams for changing the discharge property in an initiation stage of the discharge process. The cams in the cam mechanism 10 illustrated in FIGS. 1A and 1B are compensated in those shapes so that the discharge flow rate property is set at a waveform represented by the real line in FIG. 8B. Whereas the pulsation is generated in the discharge initiation stage, a removal of the pulsation from the composite discharge flow rate in the discharge actually follows the completion in compression of the residual air represented by crosshatching in FIG. 8B. The pulsation of the composite discharge flow rate could not be removed.

The second proposal is to make a cam compensation for placing the cam in discharge allowable state prior to the actual discharge timing. The shape of the cam is compensated so that the pump discharge flow rate has a waveform represented by a real line in FIG. 9B. A compression corresponding to a volume, represented by a crosshatched portion in FIG. 9B, associated with the discharge flow rate is set prior to the actual discharge, for which reason on the discharge initiation stage the discharge have already been suitable due to including an extra discharge flow rate. Such extra discharge flow rate may, however, cause an increase in the composite discharge flow rate thereby the pulsation is generated as illustrated in FIG. 9.

The third proposal is to place the cam in discharge allowable state prior to the actual discharge timing so as to set the discharge flow rate at zero in the actual discharge initiation. The shape of the cams is compensated so that the discharge flow rate has a waveform represented by a real line in FIG. 10. A compression corresponding to a volume, represented by a crosshatched portion, of the pump discharge flow rate is set prior to the actual discharge so that the discharge has already been suitable on the discharge initiation stage. At the initiation of the discharge, the discharge flow rate is set at zero so that no extra discharge flow rate is generated thereby the composite discharge flow rate has no pulsation as illustrated in FIG. 10A. Namely, the shape of the cams may be compensated so that the pulsation is removed in the discharge initiation stage.

The influences due to the above second, third and fourth factors may be resolved by making the compensation in shape of the cams to obtain pulsation free flow. In other words, the pulsation may be removed only by compensation in the shape of the cams.

As described above, the convention pulsation free pump shows the reduction in the composite discharge flow rate in its initial stage due to the residual air in the hydraulic driving section, the liquid leakage in the air extraction process and the residual air in the pump operation section and others, for which reason the reduction would be unavoidable. The unavoidable reduction may be compensated by the extra discharge flow rate to ensure the desirable pulsation free discharge flow rate.

A magnitude of the reduction of the discharge flow rate depends upon the operation conduction of the pump system such as a discharge pressure and pipe lines, while a magnitude of the extra discharge flow rate is free from such condition. To ensure the pulsation free discharge flow rate, it is necessary to adjust an amount of the extra discharge flow rate for compensations for such variable reductions of the discharge flow rate due to the variable pump conditions.

In the conventional pulsation free pumps, the adjustment for ensuring the pulsation free discharge flow rate would substantially be impossible on the ground that the compensation in the shape of the cams would be restricted and a variation in an angular velocity is limited as being substantially defined by a stepping motor. Namely, the conventional cam shape compensation method is insufficient to exactly remove the pulsation from the discharge flow rate in response to largely variable pump operation conditions.

The conventional automatic air extraction hydraulic diaphragm pumps have a structure as illustrated in FIG. 11A. Inside a diaphragm pump body 40, there is provided a hydraulic chamber 44 and a pump chamber 46 which are separated by a diaphragm 42. The hydraulic chamber 44 is provided with plunger 48 penetrating the hydraulic chamber 44. The pump chamber 46 is provided with a suction port 54 and a discharge port 56 via check valves 50 and 52 respectively. A reciprocating operation of the plunger 48 causes a variation in pressure of the oil in the hydraulic chamber 44 thereby the diaphragm shows a pulse oscillation motion which allows the pump chamber 46 to show the pump operation.

On a top portion of the diaphragm pump body 40, an oil reservoir 58 is provided wherein an oil reserving chamber 60 within the oil reservoir 58 is connected to the above hydraulic chamber 44 through a multi-function valve 60*a* and an oil passage 64 provided in the oil reservoir 58 as well as through an oil passage 66 provided in the diaphragm pump body 40. As a result, the above multi-function valve 60*a* is so operated as to supplement the oil to the hydraulic chamber 44 when the hydraulic chamber 44 is deficient in oil due to operations of the plunger 48 and further to have the oil discharge from the hydraulic chamber 44 into the oil reservoir when the hydraulic chamber 44 has an excess of the oil. The above multi-function valve 60*a* is capable both of an air extraction for discharge of bubbles generated in the hydraulic chamber 44 by operations of the plunger 48 and of a supplement of a driving oil for compensation for a reduction thereof due to a leakage from the hydraulic chamber 44. Further, there is provided a safety valve 60*b* for allowing, in the hydraulic chamber 44, an escape of the excess of the oil pressure over a regulation valve.

There is further provided a piston pump 72 for driving a piston 70 via a cam 68 showing a rotation driving which is synchronized with a reciprocal motion of the plunger 48. The multi-function valve 60*a* is coupled to the piston pump 72 via the pump chamber 74 and an oil feeder pipe 76 to force the multi-function valve 60*a* to show opening and closing operations in association with the pump operation of the piston pump 72.

As illustrated in FIG. 11B, the above multi-function valve 60*a* has a valve body 80 within which there is formed a pressure chamber 82 which is coupled via an oil passage 84 to the oil feeder pipe 76 extending from the piston pump 72. On a top of the valve body 80, a flow rate adjuster 86 comprising an orifice is provided to introduce the oil in the oil reservoir 60 into the pressure chamber 82. A piston 88 is inserted into and supported by the pressure chamber 82 so that the piston 88 is fixed at an intermediate position of the pressure chamber 82. On the bottom of the valve body 80, there is formed a stem 90 into which inserted is a valve stem 94 which is closed by a spring 92. The valve stem 94 extends to penetrate the pressure chamber 82 and a portion thereof projecting from the pressure chamber is united with a valve section 98 having a tapered shape 96. The above multi-function valve 60*a* allows the oil to be fed discontinuously by the piston pump 72 to thereby generate a pressure difference when the pressured oil passes the orifice of the flow rate adjuster 86. The pressure difference may cause the piston 88 pressed down to have the stem 90 open for oil supplement into the hydraulic chamber 44 of the diaphragm pump body 40 together with an extraction of the air generated in the hydraulic chamber 44.

The above multi-function valve 60*a* may comprise a differential pressure automatic air extraction ball valve as illustrated in FIG. 12. In FIG. 12, the differential pressure automatic air extraction ball valve 30 is provided at its top portion with an adjusting nut 31, a valve body 34 with a seat 33 for a ball 32, and a bottom screw 35 engaged with the above adjusting nut 31 wherein the screw is inserted into the valve body 34. The valve 30 is further provided with an adjustable pipe 36 with a top seat 37 for the ball 32, and a stopper nut 38 engaged with the screw 35 of the above adjustable pipe 36.

The above differential pressure automatic air extraction ball valve 30 is so constructed that the ball 32 moves from top to bottom in the initiation of the pump suction process thereby a small amount of the oil flows from the oil reservoir 60 into the hydraulic chamber 44 and further the ball 32 moves from bottom to top in an initiation of the pump discharge process thereby a small amount of the oil together with an air in the hydraulic chamber 44 is discharged flow rate of the pressured oil is set larger than the suction flow rate since a pressure difference of the oils in discharge between inside the pump chamber 46 and an atmosphere is larger than that of the oil in suction.

SUMMARY OF THE INVENTION

Accordingly, it is an object of the present invention to provide a pulsation free pump provided with a pulsation adjustable feature having a simple structure and being capable of suppressing any pulsation of the pump discharge liquid flow variable according to various pump operation conditions.

The above and other objects, features and advantages of the present invention will be apparent from the following descriptions.

The invention provides a pulsation free pump comprising the following elements. A plurality of hydraulic diaphragm pumps are provided. A plurality of plungers are also provided to correspond to the hydraulic diaphragm pumps, each of the plungers performs a reciprocal movement which provides a pumping cycle operation of a corresponding one of the plurality of hydraulic diaphragm pumps. Each of the pumping cycles comprises a discharge process and a subsequent a suction process. A controller is provided for controlling reciprocal movements of the plungers in association with each other at a predetermined difference in phase of the pumping cycle. The controller controls the reciprocal movement of each of the plungers so as to set a preliminary pressure-rising process just before the discharge process so that a discharge flow rate of each of the diaphragm pumps is initiated to increase without any time delay when the pumping cycle enters into the discharge process whereby a total discharge flow rate defined by the sum of the discharge flow rates of all the plungers is kept constant and free of any substantial pulsation.

BRIEF DESCRIPTION OF THE DRAWINGS

Preferred embodiments of the present invention will be described in detail with reference to the accompanying drawings.

FIG. 9A is a diagram illustrative of waveforms of the composite discharge flow rate for another compensation for the pulsation in the conventional pulsation free pump.

FIG. 9B is a diagram illustrative of waveforms of another compensated discharge flow rate in the conventional pulsation free pump.

FIG. 10A is a diagram illustrative of waveforms of the composite discharge flow rate for still another compensation for the pulsation in the conventional pulsation free pump.

FIG. 10B is a diagram illustrative of waveforms of still another compensated discharge flow rate in the conventional pulsation free pump.

FIG. 19 is a view illustrative of a structure of a cam mechanism for controlling reciprocal movements of a plunger in accordance with the present invention.

FIG. 20 is diagrams illustrative of waveforms of discharge flow rates of individual diaphragm pumps constituting a pulsation free pump and a variation in displacement of a plunger in accordance with the present invention.

DETAILED DESCRIPTION OF THE INVENTION

The invention provides a pulsation free pump comprising the following elements. A plurality of hydraulic diaphragm pumps are provided. A plurality of plungers are also provided to correspond to the hydraulic diaphragm pumps, each of the plungers performs a reciprocal movement which provides a pumping cycle operation of corresponding one of the plurality of hydraulic diaphragm pumps. Each of the pumping cycles comprises a discharge process and a subsequent suction process. A controller is provided for controlling reciprocal movements of the plungers in association with each other at a predetermined difference in phase of the pumping cycle. The controller controls the reciprocal movement of each of the plungers so as to set a preliminary pressure-rising process just before the discharge process so that a discharge flow rate of each of the diaphragm pumps is initiated to increase without any time delay when the pumping cycle enters into the discharge process whereby a total discharge flow rate defined by the sum of the discharge flow rates of all of the plungers is kept constant and free of any substantial pulsation.

As illustrated in FIG. 20, the above discharge process may comprise a uniformly and positively accelerated motion period during which a discharge flow rate of each of the plungers uniformly increases from zero to a positive value, a positive uniform motion period during which the increased discharge flow rate of each of the plungers remains unchanged at the positive value, and a uniformly and negatively accelerated motion period during which the discharge flow rate of each of the plungers uniformly decreases from the positive value to zero. In FIG. 20, the preliminary pressure-rising process represents a small convex of the graph just before the proportional increase in the discharge flow rate and corresponds to a hillock of the graph illustrative of the displacement of the plunger over the angle. In FIG. 20, the small convex of the graph does not mean an actual discharge but does mean a slight movement of the plunger for raising the pressure so that a discharge flow rate of the diaphragm pump is initiated to increase without any time delay when the pumping cycle enters into the discharge process whereby a total discharge flow rate defined by the sum of the discharge flow rates of all of the plungers is kept constant and free of any substantial pulsation.

Figure 21:
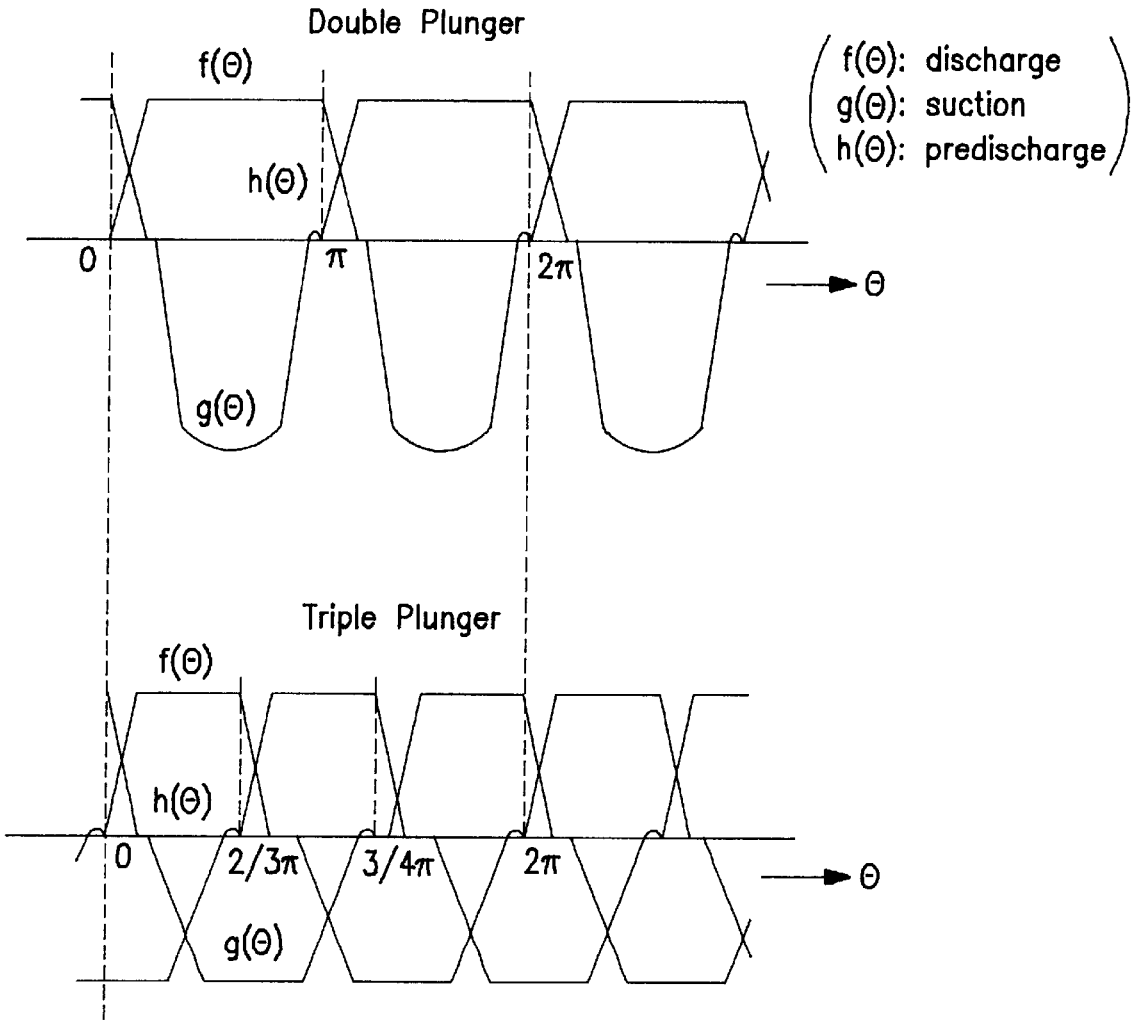
FIG. 21 is diagrams illustrative of waveforms of discharge flow rates of double and triple diaphragm pumps constituting a pulsation free pump and a variation of dislacement of a plunger in accordance with the present invention.

When the pulsation free pump comprises double plungers which operate with a 180° phase difference from each other, the discharge flow rates of the double diaphragm pumps which constitute the pulsation free pump of the present invention is as waveforms illustrated in the top of FIG. 21. On the other hand, when the pulsation free pump comprises triple plungers which operate with a 120° phase difference from each other, the discharge flow rates of the triple diaphragm pumps which constitute the pulsation free pump of the present invention is as waveforms illustrated in the bottom of FIG. 21.

The above controller may, for example, comprise a cam mechanism as illustrated in FIG. 19. As the rotation angle of the cam is increased from zero to $\pi+\theta_1$, the diameter of the cam is gradually increased so that the plunger engaged with the cam moves toward the diaphragm pump thereby providing the discharge process. Subsequently, as the rotation angle of the cam is increased from $\pi+\theta_1$ to $2\pi-\theta_2$, the cam diameter is gradually decreased so that the plunger engaged with the cam moves reversibly to the diaphragm pump thereby providing the suction process. After the suction process and just before the above discharge process, there is provided a preliminary pressure-rising process where the rotation angle of the cam is increased from $2\pi-\theta_2$ to $2\pi$. On the side face of the cam, there is formed a hillock as illustrated in FIG. 19, where the hillock extends over an angle of $\theta_2$. The hillock slightly pushes the plunger toward the diaphragm pump to cause a pressure-rising for subsequent increase in a discharge flow rate of the diaphragm pump without, however, any time delay when the pumping cycle enters into the discharge process whereby a total discharge flow rate defined by the sum of the discharge flow rates of all of the plungers is kept constant and free of any substantial pulsation.

As a further improvement, it is preferable that the diaphragm pump is a hydraulic diaphragm pump which is further provided with an air exhaust differential pressure regulating valve which operates in accordance with a difference in pressure between an external atmospheric pressure and a liquid in a pump chamber of the hydraulic diaphragm pump so that in the discharge process not only the liquid but also an air in the pump chamber are exhausted from the pump chamber by a large pressure difference through the air exhaust differential pressure regulating valve whilst in the subsequent suction process only the liquid is returned into the pump chamber so as to extract the air in the pump chamber.

The air exhaust differential pressure regulating valve may, for example, comprise a ball valve movable between an upstream valve seat position near the pump chamber at an upstream side and a downstream valve seat positioned far from the pump chamber so that in the discharge process the ball valve is made into secure contact with the downstream valve seat whilst in the subsequent suction process, the ball valve is made into secure contact with the upstream valve seat.

The distance between the upstream valve seat and the downstream valve seat is adjustable to adjust an amount of the liquid exhausted from the pump chamber in the discharge process.

The controller may be a cam mechanism which comprises the following elements. A plurality of cam followers are mechanically connected to the plungers. The cam follower is movable in a predetermined direction so that a displacement of the cam follower in the predetermined direction causes a corresponding displacement of the plunger. A single cam rotary shaft is provided which rotate on a fixed axis vertical to the predetermined direction at a predetermined constant rotation speed. A plurality of disk-like cams are provided corresponding to the plungers. The disk-like cams are rotatable in a plane vertical to the fixed axis of the single cam rotary shaft. The disk-like cams have rotation centers which are mechanically connected to the single cam rotary shaft so as to have a predetermined phase difference from each other. Each of the disk-like cams has a peripheral side edge always in contact with the cam follower. The peripheral side edge of each of the disk-like cams varies in distance from the rotation center over a rotation angle of the disk-like cam so that as the rotation angle is increased, the distance from the rotation center continuously decreases to a minimum distance to provide the suction process and then slightly increases from the minimum distance to form a hillock on the peripheral side edge of the disk-like cam so as to provide the pressure-rising process before the distance continuously increases up to a maximum distance to provide the discharge process.

The controller may alternatively be another cam mechanism which comprises as follows. A plurality of cam followers are mechanically connected to the plungers. The cam follower is moveable in a predetermined direction so that a displacement of the cam follower in the predetermined direction causes a corresponding displacement of the plunger. A single cam rotary shaft is provided which rotates on a fixed axis vertical to the predetermined direction at a predetermined constant rotation speed. A plurality of disk-like cams are provided which correspond to the plungers. The disk-like cams are rotatable in a plane vertical to the fixed axis of the single cam rotary shaft. The disk-like cams have rotation centers which are mechanically connected to the single cam rotary shaft so as to have predetermined phase difference from each other. One surface of each of the disk-like cams has an annular guide groove receiving the cam follower to engage the disk-like cam with the cam follower. The annular guide groove of each of the disk-like cams varies in distance from the rotation center over a rotation angle of the disk-like cam so that as the rotation angle is increased, the distance from the rotation center continuously decreases to a minimum distance to provide the suction process and then slightly increases from the minimum distance so as to provide the pressure-rising process before the distance continuously increases up to a maximum distance to provide the discharge process.

The controller may also be a cam mechanism which comprises as follows. A pair of cam followers are mechanically connected to two of the plungers respectively. The cam a follower is movable in a predetermined direction so that a displacement of the cam follower in the predetermined direction causes a corresponding displacement of the plunger. A single cam rotary shaft is provided which rotates on a fixed axis vertical to the predetermined direction at a predetermined constant rotation speed. A single disk-like cam is rotatable in a plane vertical to the fixed axis of the single cam rotary shaft. The single disk-like cam has a rotation center which is mechanically connected to the single cam rotary shaft. The single disk-like cam has a peripheral side edge always in contact with the paired cam followers at radially opposite ends so that the paired cam followers and the rotation center of the single disk-like cam are aligned on a straight line to provide a 180° phase difference between the plungers. The peripheral side edge of the single disk-like cam varies in distance from the rotation center over a rotation angle of the disk-like cam so that as the rotation angle is increased, the distance from the rotation center continuously decreases to a minimum distance to provide the suction process and then slightly increases from the minimum distance to form a hillock on the peripheral side edge of the disk-like cam so as to provide the pressure-rising process before the distance continuously increases up to a maximum distance to provide the discharge process.

The controller is a cam mechanism which comprises as follows. A plurality of cam followers are mechanically connected to the plungers. The cam follower is movable in a predetermined direction so that a displacement of the cam follower in the predetermined direction causes a corresponding displacement of the plunger. A single cam rotary shaft is provided which rotates on a fixed axis parallel to the predetermined direction at a predetermined constant rotation speed. A single disk-like cam is provided which is rotatable in a plane vertical to the fixed axis of the single cam rotary shaft. The single disk-like cam has a rotation center which is mechanically connected to the single cam rotary shaft. One surface of the single disk-like cam has an annular ridge projecting in parallel to the fixed axis of the single cam rotary shaft so that a top surface of the annular ridge is always in contact with the cam followers. The annular ridge of the single disk-like cam varies in height over a rotation angle of the disk-like cam so that as the rotation angle is increased, the height of the annular ridge continuously decreases to a minimum height to provide the suction process and then slightly increases from the minimum height to form a hillock on the top surface of the annular ridge so as to provide the pressure-rising process before the height continuously increases up to a maximum height to provide the discharge process.

The controller may also be a cam mechanism which comprises as follows. A plurality of cam followers are mechanically connected to the plungers. The cam follower is movable in a predetermined direction so that a displacement of the cam follower in the predetermined direction causes a corresponding displacement of the plunger. A single cam rotary shaft is provided which rotates on a fixed axis parallel to the predetermined direction at a predetermined constant rotation speed. A single cylindrically shaped cam is provided which is rotatable in a plane vertical to the fixed axis of the single cam rotary shaft. The single cylindrically shaped cam has a rotation center which is mechanically connected to the single cam rotary shaft. A cylindrical side face of the single cylindrically shaped cam has an annular guide groove receiving the cam follower to engage the single cylindrically shaped cam with the cam followers. The annular guide groove of the single cylindrically shaped cam varies in level parallel to the fixed axis over a rotation angle of the single cylindrically shaped cam so that as the rotation angle is increased, the level of the annular guide groove continuously drops to a bottom level to provide the suction process and then slightly rises from the bottom level to provide the pressure-rising process before the level of the annular guide groove continuously rises up to a top level to provide the discharge process.

The controller is a cam mechanism which comprises as follows. A plurality of cam followers are mechanically connected to the plungers. The cam follower is movable in a predetermined direction so that a displacement of the cam follower in the predetermined direction causes a corresponding displacement of the plunger. A single cam rotary shaft is provided which rotates on a fixed axis parallel to the predetermined direction at a predetermined constant rotation speed. A single cylindrically shaped cam is provided which is rotatable in a plane vertical to the fixed axis of the single cam rotary shaft. The single cylindrically shaped cam has a rotation center which is mechanically connected to the single cam rotary shaft. A cylindrical side face of the single cylindrically shaped cam has an annular rim engaged with the cam follower to engage the single cylindrically shaped cam with the cam followers. The annular rim of the single cylindrically shaped cam varies in level parallel to the fixed axis over a rotation angle of the single cylindrically shaped cam so that as the rotation angle is increased, the level of the annular rim continuously drops to a bottom level to provide the suction process and then slightly rises from the bottom level to provide the pressure-rising process before the level of the annular rim continuously rises up to a top level to provide the discharge process.

The annular rim is sandwiched between a pair of rollers which constitute each of the cam followers.

The controller may also be a cam mechanism which comprises as follows. A plurality of driving motors are provided which correspond to the plungers. Each of the driving motors is capable of bi-directional variable-speed rotations. A plurality of rotary-to-linear motion converters are mechanically connected at one end thereof to the driving motors and also mechanically connected at the opposite end thereof to the plungers. Each of the rotary-to-linear motion converters convert bi-directional variable-speed rotary motions of the driving motor into bi-directional variable-speed linear motions of the plunger so that the rotary-to-linear motion converter makes the plunger vary in displacement in accordance with rotation angle of the driving motor. The driving motor rotates in a first direction at variable speeds so as to make a displacement of the plunger from a reference position continuously decrease to a minimum displacement thereby providing the suction process and subsequently the driving motor is reversed to slightly rotate in a second direction so as to make the displacement of the plunger increase from the minimum displacement thereby providing the pressure-rising process before the driving motor remains rotating in the second direction at variable speeds so as to make the displacement of the plunger continuously increase up to a maximum displacement thereby providing the discharge process.

The driving motor may preferably comprise a stepping motor. Each of the rotary-to-linear motion converters comprises a cylinder which is mechanically connected to the plunger and capable of bi-directional linear motions along with the plunger. The cylinder has a cylindrically shaped inner wall formed thereon with first helical ball spline grooves receiving ball bearings. A screw is mechanically connected to the stepping motor and capable of bi-directional rotary motions. The screw has a cylindrical side face formed thereon with second helical ball spline grooves receiving the ball bearings through which the screw is mechanically engaged with the cylindrically shaped inner wall of the cylinder so that the bi-directional rotary motions of the screw are converted into the bi-directional linear motions of the cylinder.

The driving motor may preferably comprise a stepping motor, and each of the rotary-to-linear motion converters may comprise a cylinder which is mechanically connected to the stepping motor and capable of bi-directional rotary motions along with the stepping motor. The cylinder has a cylindrically shaped inner wall formed thereon with first helical ball spline grooves receiving ball bearings. A screw is mechanically connected to the plunger and capable of bi-directional linear motions. The screw has a cylindrical side face formed thereon with second helical ball spline grooves receiving the ball bearings through which the screw is mechanically engaged with the cylindrically shaped inner wall of the cylinder so that the bi-directional rotary motions of the cylinder are converted into the bi-directional linear motions of the screw.

The plungers may comprise first and second plungers and the controller may be a cam mechanism which comprises as follows. A single driving motor is capable of bi-directional variable-speed rotations. A transmission gear mechanism is mechanically engaged with the single driving motor. First and second rotary-to-linear motion converters are mechanically connected at one end thereof via the transmission gear mechanism to the single driving motor. The first and second rotary-to-linear motion converters are mechanically connected at the opposite end thereof to the first and second plungers respectively. The first and second rotary-to-linear motion converters convert variable-speed rotary motions in different directions from each other into variable-speed linear motions of the first and second plungers in opposite directions to each other so that the first and second rotary-to-linear motion converters make the first and second plungers vary in displacement in opposite directions to each other according to rotation angle of the driving motor. The single driving motor rotates in a first direction at variable speeds so as to make a displacement of the first plunger continuously decrease to a minimum displacement thereby providing the suction process and simultaneously make a displacement of the second plunger continuously increase up to a maximum displacement thereby providing the discharge process. Subsequently, the single driving motor is reversed to slightly rotate in a second direction so as to make the displacement of the first plunger slightly increase from the minimum displacement thereby providing the pressure-rising process and simultaneously make the displacement of the second plunger slightly decrease from the maximum displacement thereby providing a pressure-dropping process, before the driving motor remains rotating in the second direction at variable speeds so as to make the displacement of the first plunger continuously increase up to a maximum displacement thereby providing the discharge process and simultaneously make the displacement of the second plunger continuously decrease to a minimum displacement thereby providing the suction process. Thereafter, the single driving motor is reversed to slightly rotate again in the first direction so as to make the displacement of the first plunger slightly decrease from the maximum displacement thereby providing the pressure-dropping process and simultaneously make the displacement of the second plunger slightly increase from the minimum displacement thereby providing a pressure-rising process.

The driving motor may preferably comprise a stepping motor and each of the first and second rotary-to-linear motion converters may comprise a cylinder being mechanically connected to the plunger and capable of bi-directional linear motions along with the plunger, and the cylinder having a cylindrically shaped inner wall formed thereon with first helical ball spline grooves receiving ball bearings. A screw is mechanically connected through the transmission gear mechanism to the stepping motor and capable of bi-directional rotary motions. The screw has a cylindrical side face formed thereon with second helical ball spline grooves receiving the ball bearings through which the screw is mechanically engaged with the cylindrically shaped inner wall of the cylinder so that the bi-directional rotary motions of the screw are converted into the bi-directional linear motions of the cylinder.

The driving motor may comprise a stepping motor, and each of the first and second rotary-to-linear motion converters may comprise a cylinder which is mechanically connected through the gear mechanism to the stepping motor and capable of bi-directional rotary motions along with the stepping motor. The cylinder has a cylindrically shaped inner wall formed thereon with first helical ball spline grooves receiving ball bearings. A screw is mechanically connected to the plunger and capable of bi-directional linear motions. The screw has a cylindrical side face formed thereon with second helical ball spline grooves receiving the ball bearings through which the screw is mechanically engaged with the cylindrically shaped inner wall of the cylinder so that the bi-directional rotary motions of the cylinder are converted into the bi-directional linear motions of the screw.

DESCRIPTION OF THE PREFERRED EMBODIMENTS

Figure 1A:
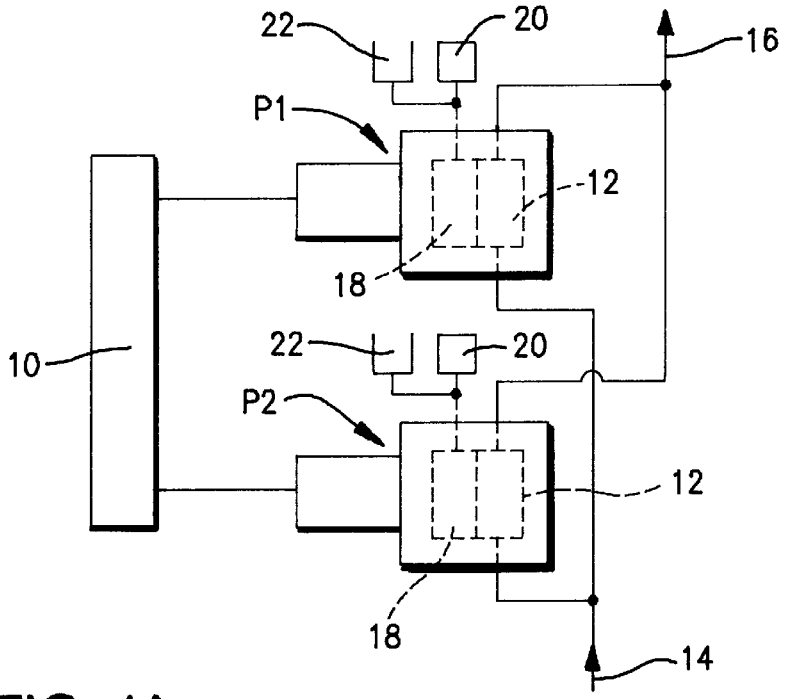
FIG. 1A PRIOR ART
FIG. 1A is a diagram illustrative of a configuration of the twin pulsation free pumps arranged in parallel to each other.
Figure 1B:
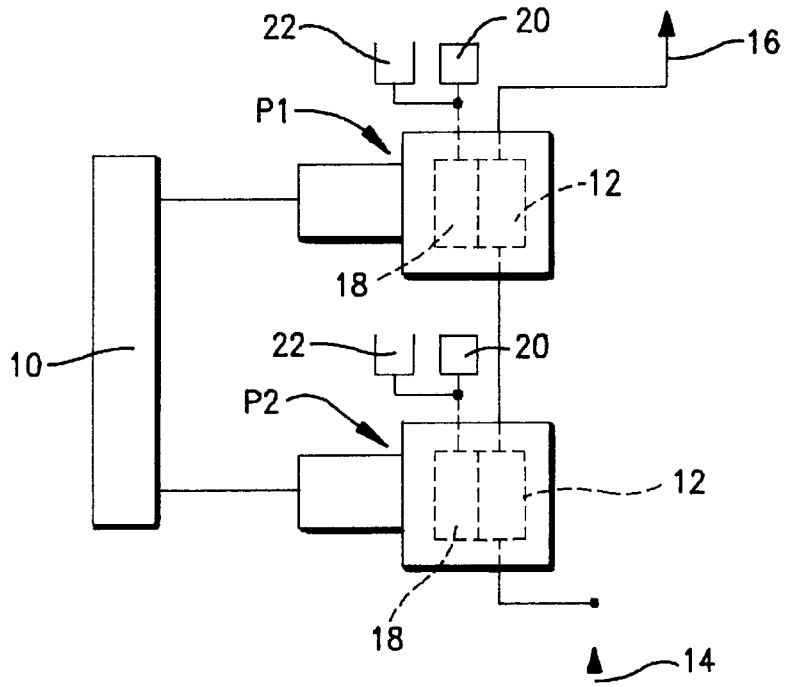
FIG. 1B PRIOR ART
FIG. 1B is a diagram illustrative of a configuration of the twin pulsation free pumps arranged in series.
Figure 2A:
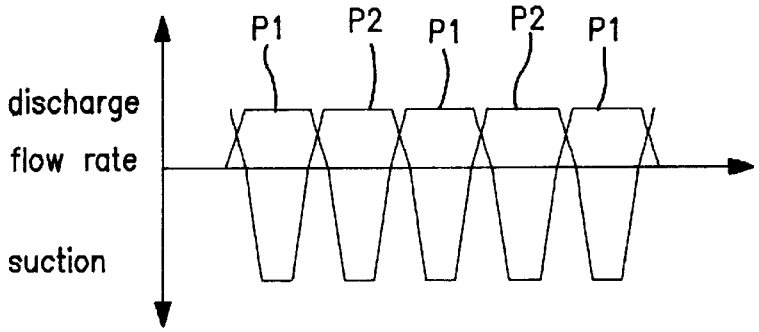
FIG. 2A PRIOR ART
FIG. 2A is a diagram illustrative of waveforms associated with a discharge flow rate property of the conventional twin pulsation free pump.
Figure 2B:
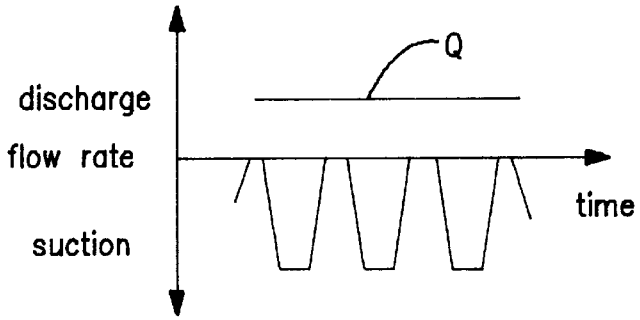
FIG. 2B PRIOR ART
FIG. 2B is a diagram illustrative of waveforms associated with a composite discharge flow rate property of the conventional twin pulsation free pump.
Figure 3A:
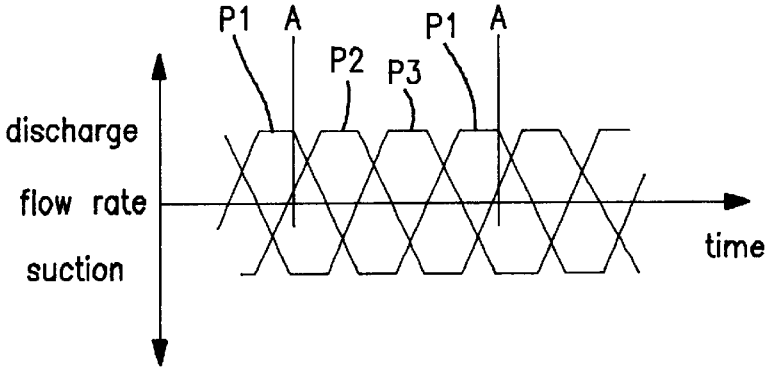
FIG. 3A PRIOR ART
FIG. 3A is a diagram illustrative of waveforms associated with a discharge flow rate property of the conventional triple pulsation free pump.
Figure 3B:
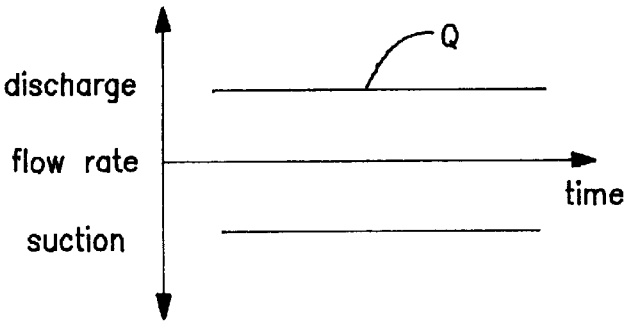
FIG. 3B PRIOR ART
FIG. 3B is a diagram illustrative of waveforms associated with a composite discharge flow rate property of the conventional triple pulsation free pump.
Figure 4A:
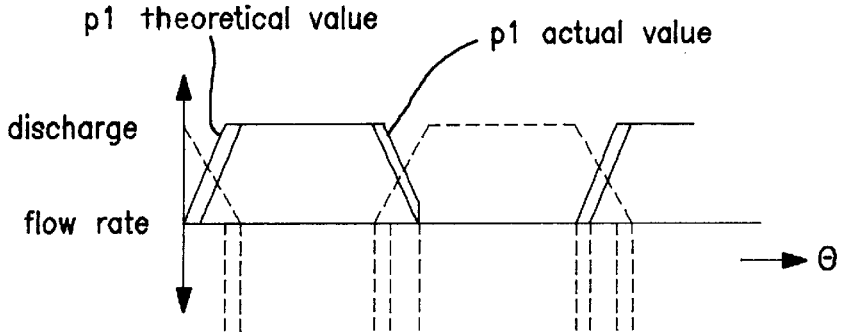
FIG. 4A PRIOR ART
FIG. 4A is a diagram illustrative of waveforms associated with a discharge flow rate for generation of pulsation of the conventional pulsation free pump.
Figure 4B:
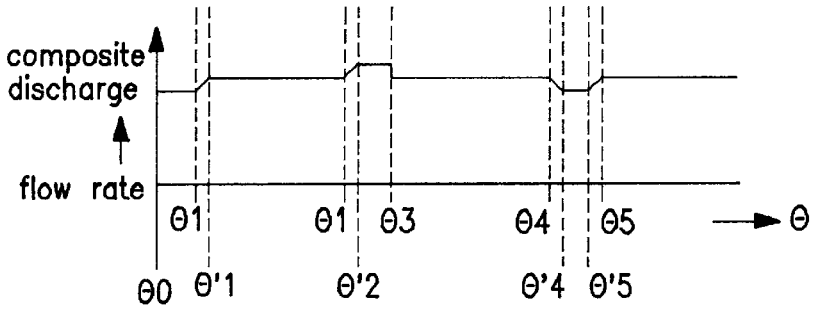
FIG. 4B PRIOR ART
FIG. 4B is a diagram illustrative of waveforms associated with a composite discharge flow rate for generation of pulsation of the conventional pulsation free pump.
Figure 5A:
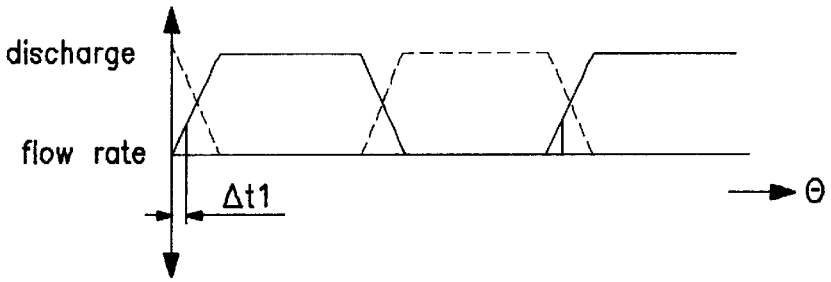
FIG. 5A PRIOR ART
FIG. 5A is a diagram illustrative of waveforms associated with a discharge flow rate for generations of another pulsation of the conventional pulsation free pump.
Figure 5B:
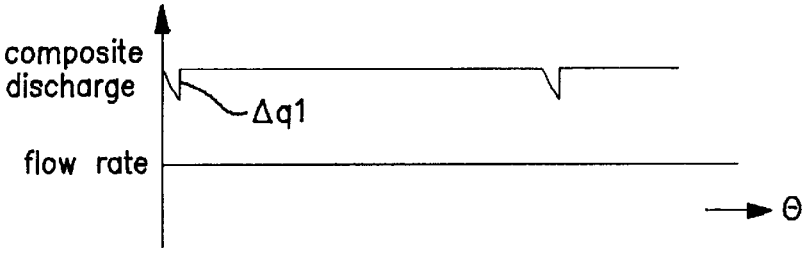
FIG. 5B PRIOR ART
FIG. 5B is a diagram flow rate for generation of another pulsation of the conventional pulsation free pump.
Figure 6A:
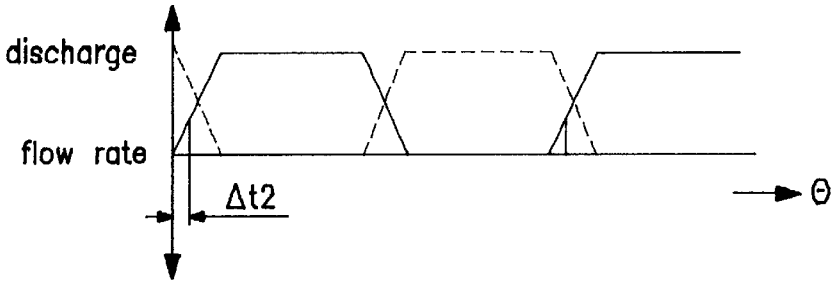
FIG. 6A PRIOR ART
FIG. 6A is a diagram illustrative of waveforms associated with a discharge flow rate for generation of still another pulsation of the conventional pulsation free pump.
Figure 6B:
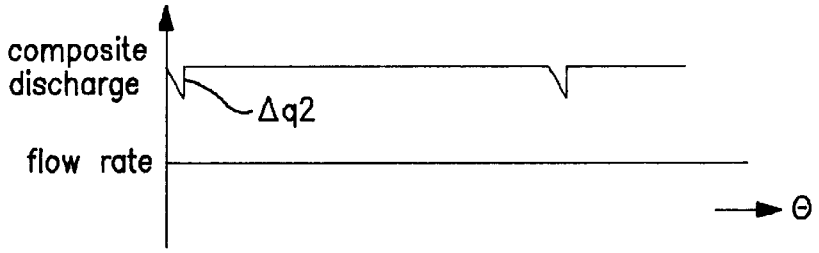
FIG. 6B PRIOR ART
FIG. 6B is a diagram illustrative of waveforms associated with a composite discharge flow rate for generation of still another pulsation of the conventional pulsation free pump.
Figure 8A:
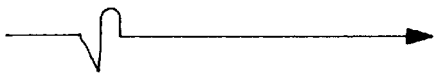
FIG. 8A PRIOR ART
FIG. 8A is a diagram illustrative of waveforms of the composite discharge flow rate for compensation for the pulsation in the conventional pulsation free pump.
Figure 8B:
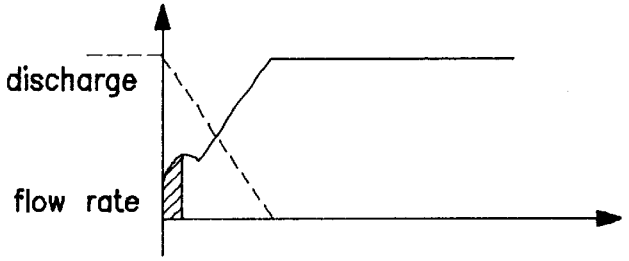
FIG. 8B PRIOR ART
FIG. 8B is a diagram illustrative of waveforms of a compensated discharge flow rate in the conventional pulsation free pump.
Figure 7A:
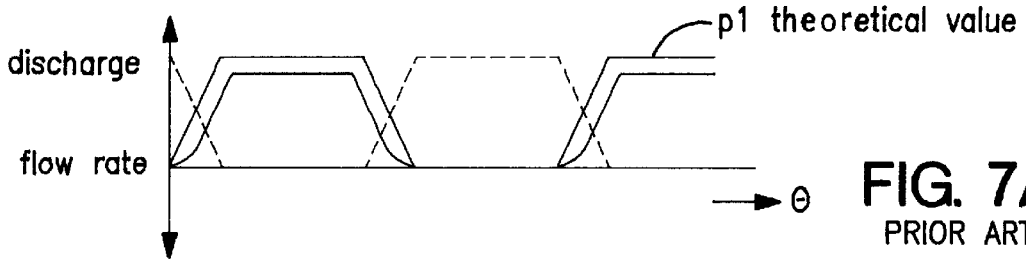
FIG. 7A PRIOR ART
FIG. 7A is a diagram illustrative of waveforms associated with a discharge flow rate for generation of yet another pulsation due to a liquid leakage from a check valve at a discharge side of the conventional pulsation free pump.
Figure 7B:
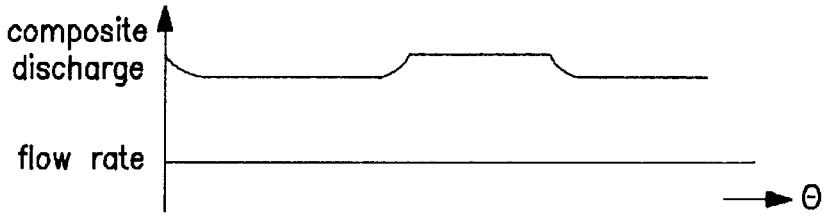
FIG. 7B PRIOR ART
FIG. 7B is a diagram illustrative of waveforms associated with a composite discharge flow rate for generation of yet another pulsation due to a liquid leakage from a check valve at a discharge side of the conventional pulsation free pump.
Figure 7C:
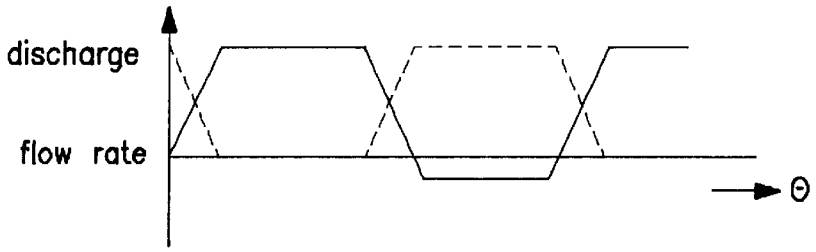
FIG. 7C PRIOR ART
FIG. 7C is a diagram illustrative of waveforms associated with a discharge flow rate for generation of yet another pulsation due to a liquid leakage from a check valve at a suction side of the conventional pulsation free pump.
Figure 7D:
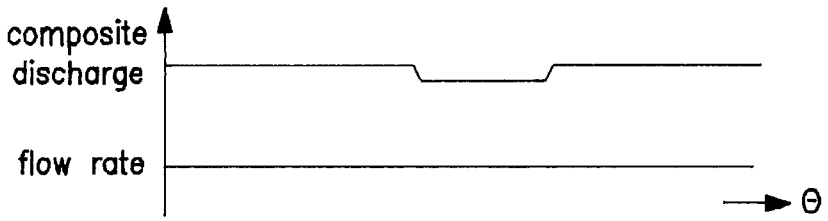
FIG. 7D PRIOR ART
FIG. 7D is a diagram illustrative of waveforms associated with a composite discharge flow rate for generation of yet another pulsation due to a liquid leakage from a check valve at a suction side of the conventional pulsation free pump.

A preferred embodiment according to the present invention will be described. The structure of the pulsation free pump is the same as the conventional one described above and illustrated in FIG. 1, except for the controller of the double or triple plungers. The following descriptions will be highlighted on the control mechanism for controlling the reciprocal motions of the double or triple plungers. As already described with reference to FIGS. 20–22, double hydraulic diaphragm pumps are provided. A plurality of plungers 34-1 and 34-2 are also provided to correspond to the hydraulic diaphragm pumps not illustrated in FIGS. 22A and 22B, each of the plungers performs a reciprocal movement which provides a pumping cycle operation of corresponding one of the plurality of hydraulic diaphragm pumps. Each of the pumping cycles comprises a discharge process and a subsequent suction process. A controller 32 is provided for controlling reciprocal movements of the plungers in association with each other at a 180° phase difference of the pumping cycle. The controller 32 controls the reciprocal movement of each of the plungers so as to set a preliminary pressuring process just before the discharge process so that a discharge flow rate of each of the diaphragm pumps is initiated to increase without any time delay when the pumping cycle enters into the discharge process whereby a total discharge flow rate defined by the sum of the discharge flow rates of all of the plungers is kept constant and free of any substantial pulsation.

As illustrated in FIG. 20, the above discharge process may comprise a uniformly and positively accelerated motion period during which a discharge flow rate of each of the plungers uniformly increases from zero to a positive value, a positive uniform motion period during which the increased discharge flow rate of each of the plungers remains unchanged at the positive value, and a uniformly and negatively accelerated motion period during which the discharge flow rate of each of the plungers uniformly decreases from the positive value to zero. In FIG. 20, the preliminary pressure-rising process represents a small convex of the graph just before the proportional increase in the discharge flow rate and corresponds to a hillock of the graph illustrative of the displacement of the plunger over angle. In FIG. 20, the small convex of the graph does not mean an actual discharge but does mean a slight movement of the plunger for rising the pressure so that a discharge flow rate of the diaphragm pump is initiated to increase without any time delay when the pumping cycle enters into the discharge process whereby a total discharge flow rate defined by the sum of the discharge flow rates of all of the plungers is kept constant and free of any substantial pulsation.

When the pulsation free pump comprises double plungers which operate with a 180° phase difference from each other, the discharge flow rates of the double diaphragm pumps which constitute the pulsation free pump of the present invention is as waveforms illustrated in the top of FIG. 21. On the other hand, when the pulsation free pump comprises triple plungers which operate with a 120° phase difference from each other, the discharge flow rates of the triple diaphragm pumps which constitute the pulsation free pump of the present invention is as waveforms illustrated in the bottom of FIG. 21.

Figure 22B:
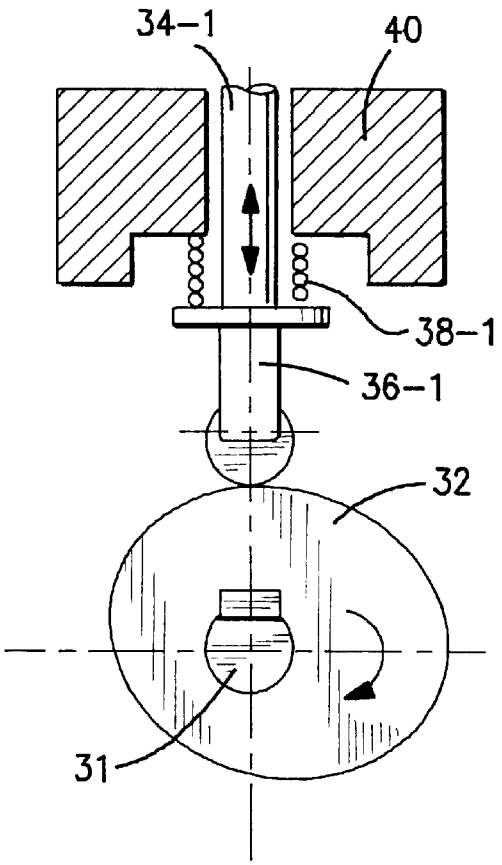
FIGS. 22A and 22B are views illustrative of a cam mechanism used as a controller for controlling a reciprocal movement of double plungers in a first embodiment according to the present invention.
Figure 22A:
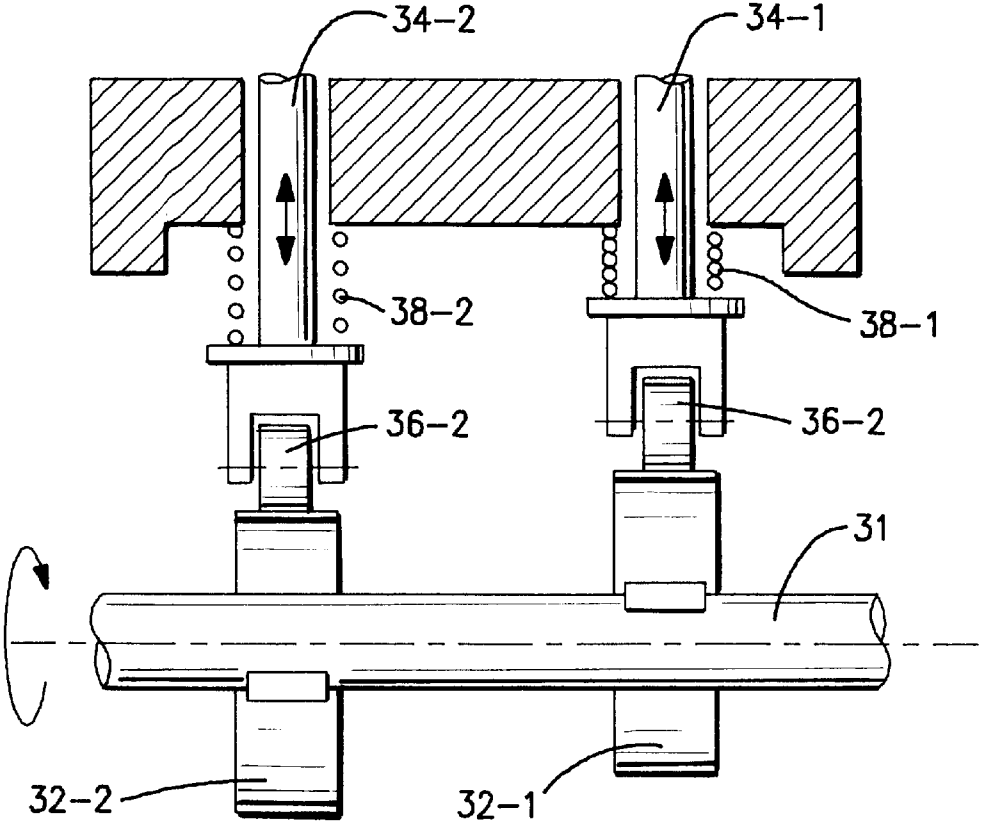

The above controller may, for example, comprise a cam mechanism 32 as illustrated in FIGS. 19 and 22A–22B. As the rotation angle of the cam is increased from zero to $\pi+\theta_1$, the diameter of the cam is gradually increased so that the plunger engaged with the cam moves toward the diaphragm pump thereby providing the discharge process. Subsequently, as the rotation angle of the cam is increased from $\pi+\theta_1$ to $2\pi-\theta_2$, the cam diameter is gradually decreased so that the plunger engaged with the cam moves reversibly to the diaphragm pump thereby providing the suction process. After the suction process and just before the above discharge process, there is provided a preliminary pressure-rising process where the rotation angle of the cam is increased from $2\pi-\theta_2$ to $2\pi$. On the side face of the cam, there is formed a hillock as illustrated in FIG. 19, where the hillock extends over an angle of $\theta_2$. The hillock slightly pushes the plunger toward the diaphragm pump to cause a pressure-rising for subsequent increase in a discharge flow rate of the diaphragm pump without, however, any time delay when the pumping cycle enters into the discharge process whereby a total discharge flow rate defined by the sum of the discharge flow rates of all of the plungers is kept constant and free of any substantial pulsation.

As a further improvement, it is preferable that the diaphragm pump is a hydraulic diaphragm pump which is further provided with an air exhaust differential pressure regulating valve which operates in accordance with a difference in pressure between an external atmospheric pressure and a liquid in a pump chamber of the hydraulic diaphragm pump so that in the discharge process not only the liquid but also an air in the pump chamber are exhausted from the pump chamber by a large pressure difference through the air exhaust differential pressure regulating valve whilst in the subsequent suction process only the liquid is returned into the pump chamber so as to extract the air in the pump chamber.

The air exhaust differential pressure regulating valve may, for example, comprise a ball valve movable between an upstream valve seat positioned near the pump chamber at an upstream side and a downstream valve seat positioned far from the pump chamber so that in the discharge process the ball valve is made into securely contact with the downstream valve seat whilst in the subsequent suction process the ball valve is made into securely contact with the upstream valve seat.

The distance between the upstream valve seat and the downstream valve seat is adjustable to adjust an amount of the liquid exhausted from the pump chamber in the discharge process.

The controller may be a cam mechanism illustrated in FIGS. 22A and 22B. Two cam followers 36-1 and 36-2 are mechanically connected to the plungers 34-1 and 34-2. The cam followers 36-1 and 36-2 are movable in a predetermined direction represented by arrow mark so that displacements of the cam followers 36-1 and 36-2 in the predetermined direction causes corresponding displacements of the plungers 34-1 and 34-2. A single cam rotary shaft 31 is provided which rotates on a fixed axis represented by a broken line and is vertical to the above predetermined direction at a predetermined constant rotation speed. Double disk-like cams 32-1 and 32-2 are provided corresponding to the plungers 34-1 and 34-2. The disk-like cams 32-1 and 32-2 are rotatable in a plane vertical to the fixed axis of the single cam rotary shaft 31. The disk-like cams 32-1 and 32-2 have rotation centers which are mechanically connected to the single cam rotary shaft 31 so as to have a 180° phase difference from each other. The disk-like cams 32-1 and 32-2 have peripheral side edges always in contact with the cam followers 36-1 and 36-2 because the cam followers 36-1 and 36-2 are pushed toward the cams by spring members 38-1 and 38-2 which are supported on a housing 40. The peripheral side edge of each of the disk-like cams 32-1 and 32-2 varies in distance from the rotation center over a rotation angle of the disk-like cam 32-1, 32-2 so that as the rotation angle is increased, the distance from the rotation center continuously decreases to a minimum distance to provide the suction process and then slightly increases from the minimum distance to form a hillock on the peripheral side edge of the disk-like cam 32-1, 32-2 so as to provide the pressure-rising process before the distance continuously increases up to a maximum distance to provide the discharge process.

Figure 23B:
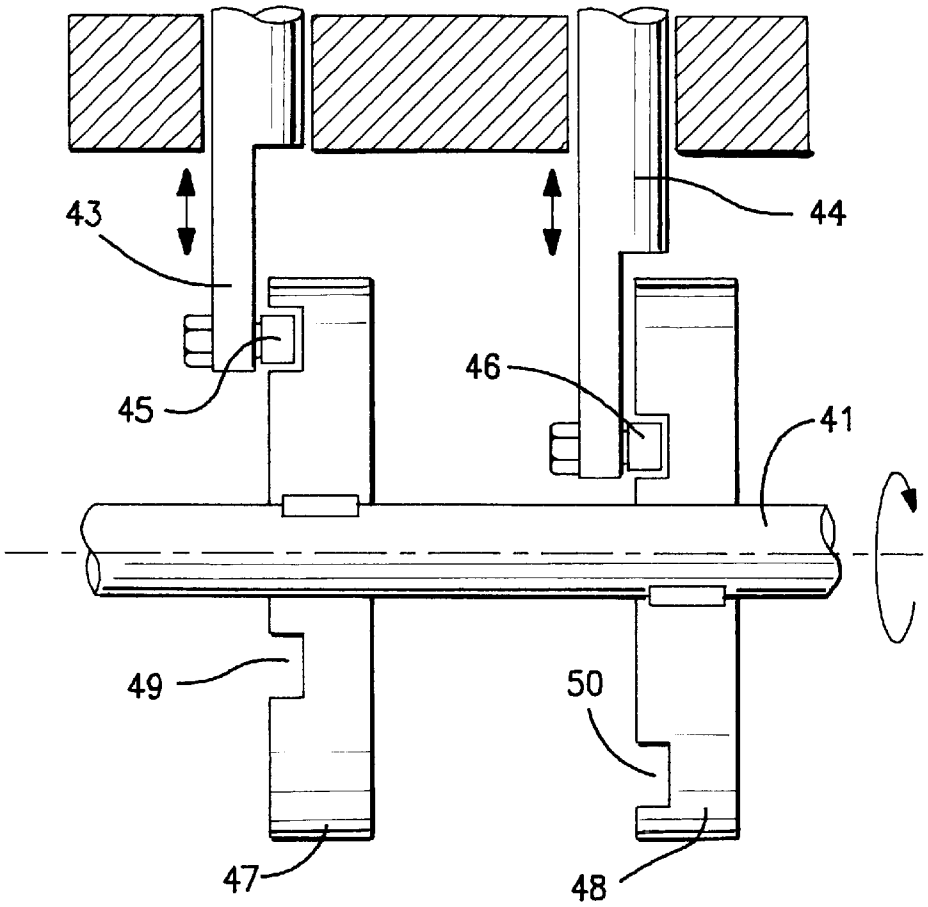
FIGS. 23A and 23B are views illustrative of a cam mechanism used as a controller for controlling a reciprocal movement of double plungers in a second embodiment according to the present invention.
Figure 23A:
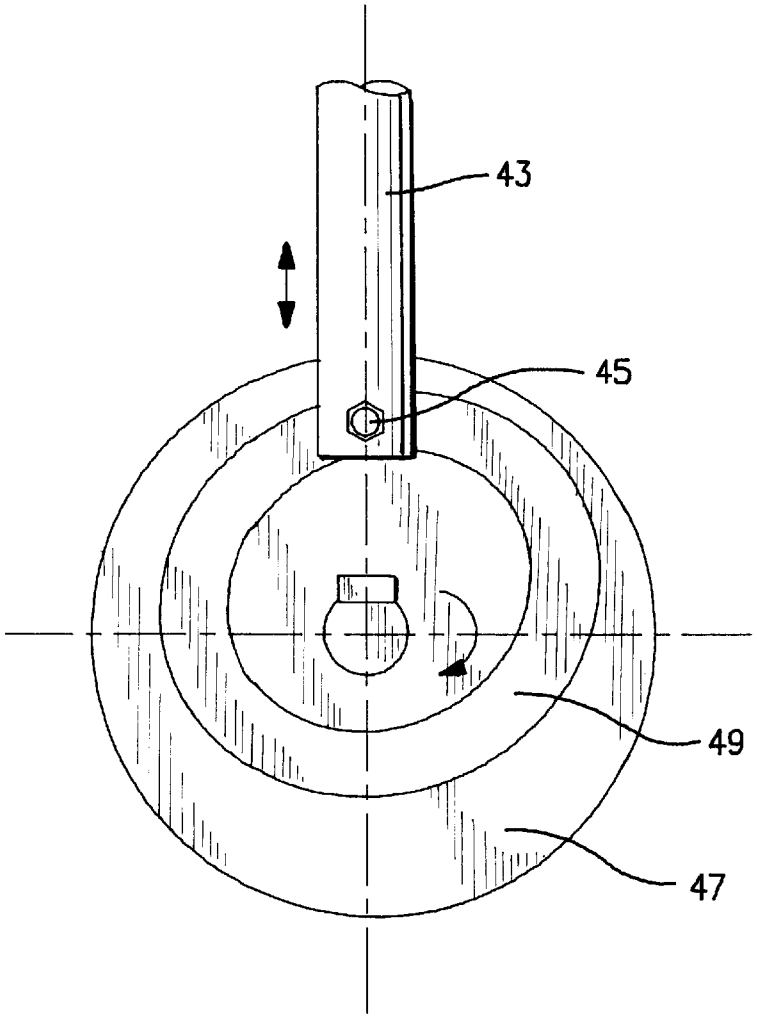

A second embodiment according to the present invention will be described in detail with reference to FIGS. 23A and 23B, a pulsation free pump is provided, which has the same structure as in the first embodiment, except for the controller mechanism which controls the reciprocal movements of double plungers 43,44, for which reason the description will focus only on the controller mechanism.

Double cam followers 45 and 46 are mechanically connected to the plungers 43 and 44. The cam followers 45 and 46 are movable in a predetermined direction represented by arrow marks so that displacements of the cam followers 45 and 46 in the predetermined direction cause corresponding displacements of the plungers 43 and 44. A single cam rotary shaft 41 is provided which rotates on a fixed axis represented by a broken line and vertical to the predetermined direction at a predetermined constant rotation speed. Double disk-like cams 47 and 48 are provided which correspond to the plungers 43 and 44. The disk-like cams 47 and 48 are rotatable in a plane vertical to the fixed axis of the single cam rotary shaft 41. The disk-like cams 47 and 48 have rotation centers which are mechanically connected to the single cam rotary shaft 31 so as to have a 1800 phase difference from each other. One side surfaces of the disk-like cams 47 and 48 have annular guide grooves 49 and 50 receiving the cam followers 45 and 46 respectively to engage the disk-like cams 47 and 48 with the cam followers 45 and 46. The annular guide grooves 49 and 50 of the disk-like cams 47 and 48 varies in distance from the rotation center over a rotation angle of the disk-like cams 47 and 48 so that as the rotation angle is increased, the distance from the rotation center continuously decreases to a minimum distance to provide the suction process and then slightly increases from the minimum distance so as to provide the pressure-rising process before the distance continuously increases up to a maximum distance to provide the discharge process.

Figure 24:
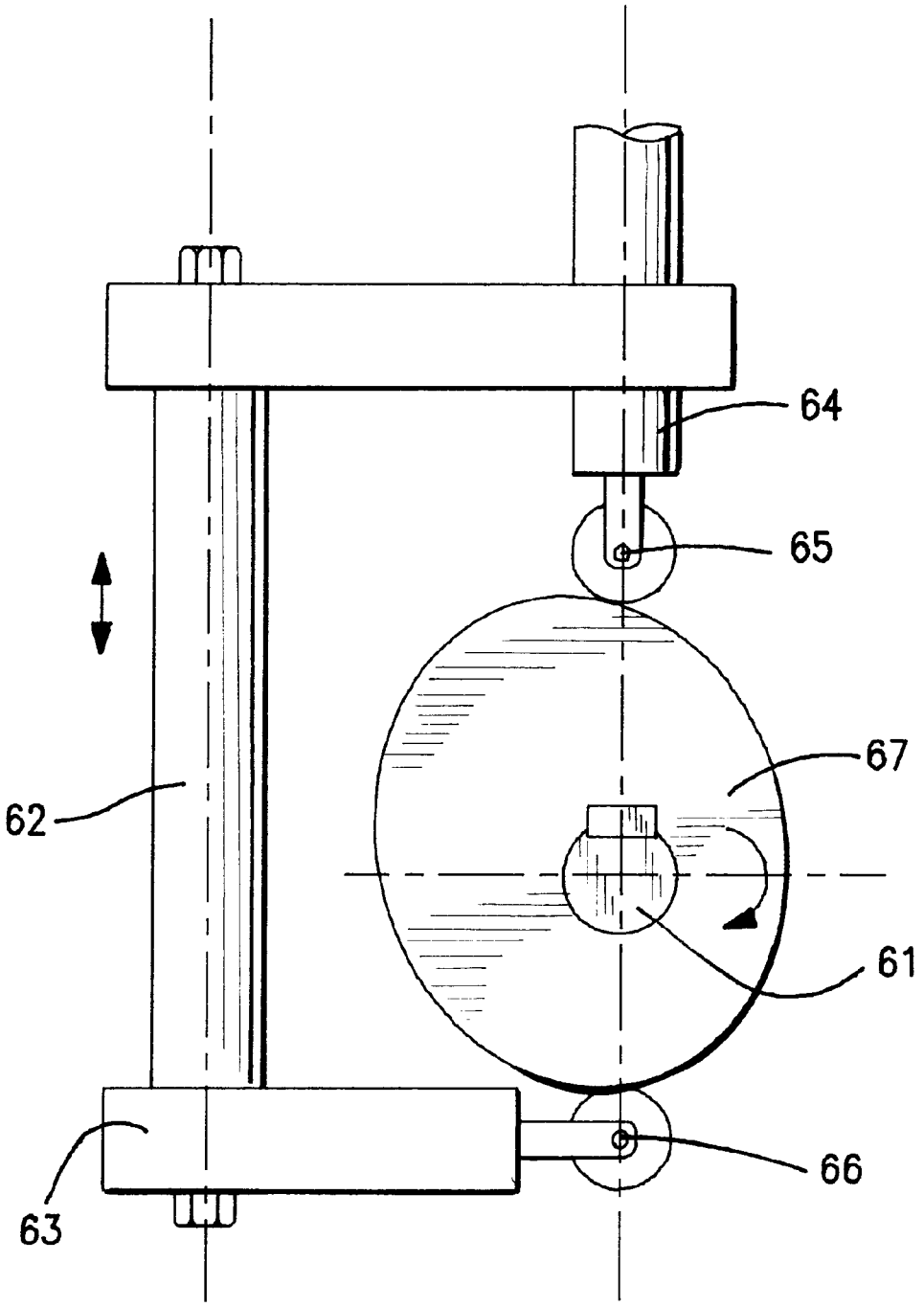
FIG. 24 is a view illustrative of a cam mechanism used as a controller for controlling a reciprocal movement of double plungers in a third embodiment according to the present invention.

A third embodiment according to the present invention will be described in detail with reference to FIG. 24, a pulsation free pump is provided, which has the same structure as in the first embodiment, except for the controller mechanism which controls the reciprocal movements of double plungers 62, 64, for which reason the description will focus only on the controller mechanism.

A pair of cam followers 65 and 66 are mechanically connected to two of the plungers respectively. The cam follower is movable in a predetermined direction so that a displacement of the cam follower in the predetermined direction causes a corresponding displacement of the plunger. A single cam rotary shaft is provided which rotates on a fixed axis vertical to the predetermined direction at a predetermined constant rotation speed. A single disk-like cam 67 is rotatable in a plane vertical to the fixed axis of he single cam rotary shaft. The single disk-like cam has a rotation center which is mechanically connected to the single cam rotary shaft. The single disk-like cam has a peripheral side edge always in contact with the paired cam followers at radially opposite ends so that the paired cam followers and the rotation center of the single disk-like cam are aligned on a straight line to provide a 180° phase difference between the plungers. The peripheral side edge of the single disk-like cam varies in distance from the rotation center over a rotation angle of the disk-like cam so that as the rotation angle is increased, the distance from the rotation center continuously decreases to a minimum distance to provide the suction process and then slightly increases from the minimum distance to form a hillock on the peripheral side edge of the disk-like cam so as to provide the pressure-rising process before the distance continuously increases up to a maximum distance to provide the discharge process.

Figure 25:
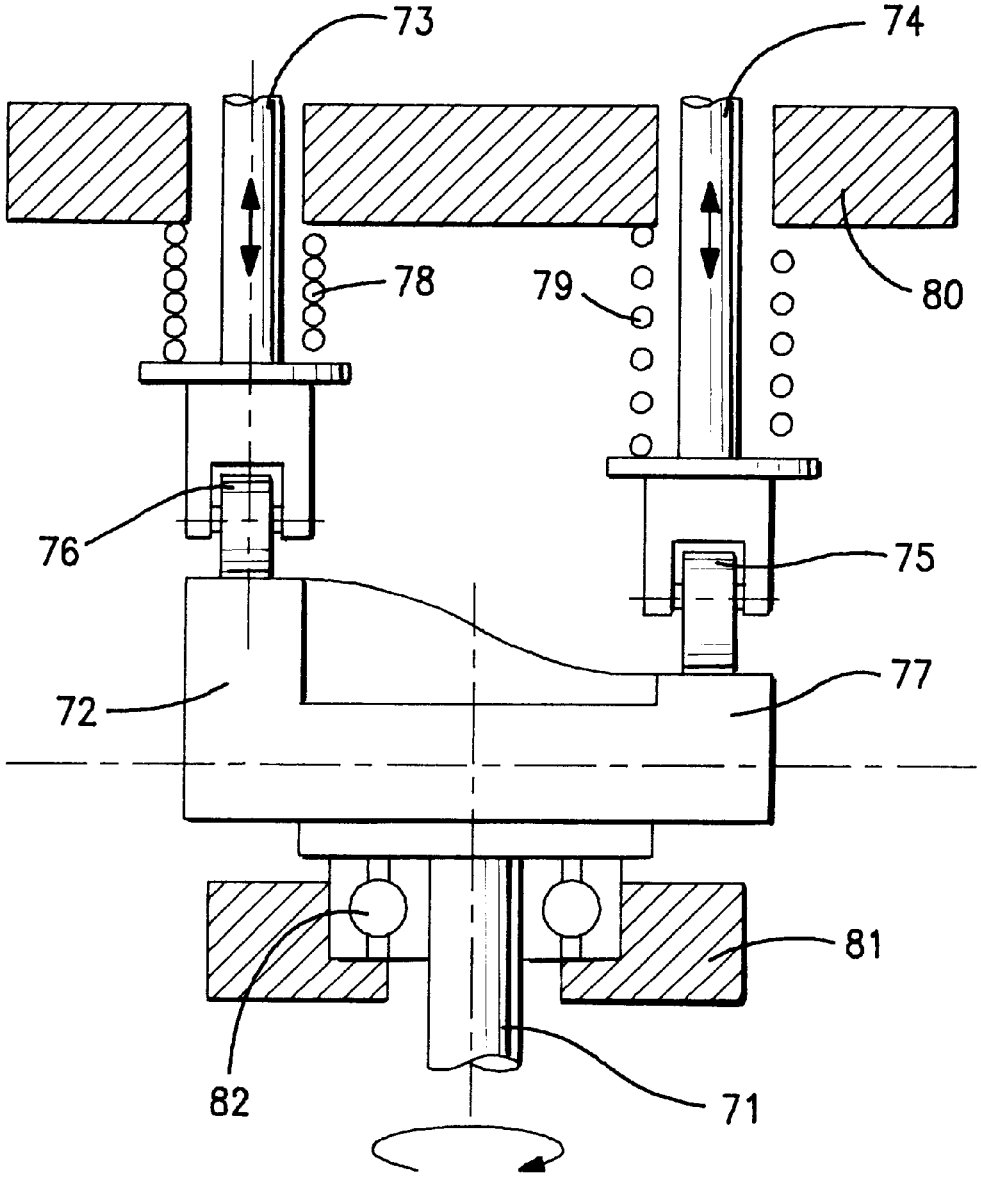
FIG. 25 is a view illustrative of a cam mechanism used as a controller for controlling a reciprocal movement of double plungers in a fourth embodiment according to the present invention.

A fourth embodiment according to the present invention will be described in detail with reference to FIG. 25, a pulsation free pump is provided, which has the same structure as in the first embodiment, except for the controller mechanism which controls the reciprocal movements of double plungers 73, 74, for which reason the description will focus only on the controller mechanism.

Double cam followers 75 and 76 are mechanically connected to the plungers 74 and 73 respectively. The cam followers 75 and 76 are movable in a predetermined direction so that displacements of the cam followers 75 and 76 in the predetermined direction cause corresponding displacements of the plungers 74 and 73. A single cam rotary shaft 71 is provided which rotates on a fixed axis parallel to the predetermined direction at a predetermined constant rotation speed. A single disk-like cam 77 is provided which is rotatable in a plane vertical to the fixed axis of the single cam rotary shaft 71. The single cam rotary shaft 71 is mechanically supported by ball bearings 82 which is further supported by a first housing member 81. The single disk-like cam 77 has a rotation center which is mechanically connected to the single cam rotary shaft 71. One surface of the single disk-like cam 77 has an annular ridge 72 projecting in parallel to the fixed axis of the single cam rotary shaft 71 so that a top surface of the annular ridge 72 is always in contact with the cam followers 75 and 76 because the cam followers 75 and 76 are pushed toward the single disk-like cam 77 by spring members 79 and 98 which are supported by a second housing member 80. The annular ridge 72 of the single disk-like cam 77 varies in height over a rotation angle of the disk-like cam 77 so that as the rotation angle is increased, the height of the annular ridge 72 continuously decreases to a minimum height to provide the suction process and then slightly increases from the minimum height to form a hillock on the top surface of the annular ridge 72 so as to provide the pressure-rising process before the height of the annular ridge 72 continuously increases up to a maximum height to provide the discharge process.

Figure 26:
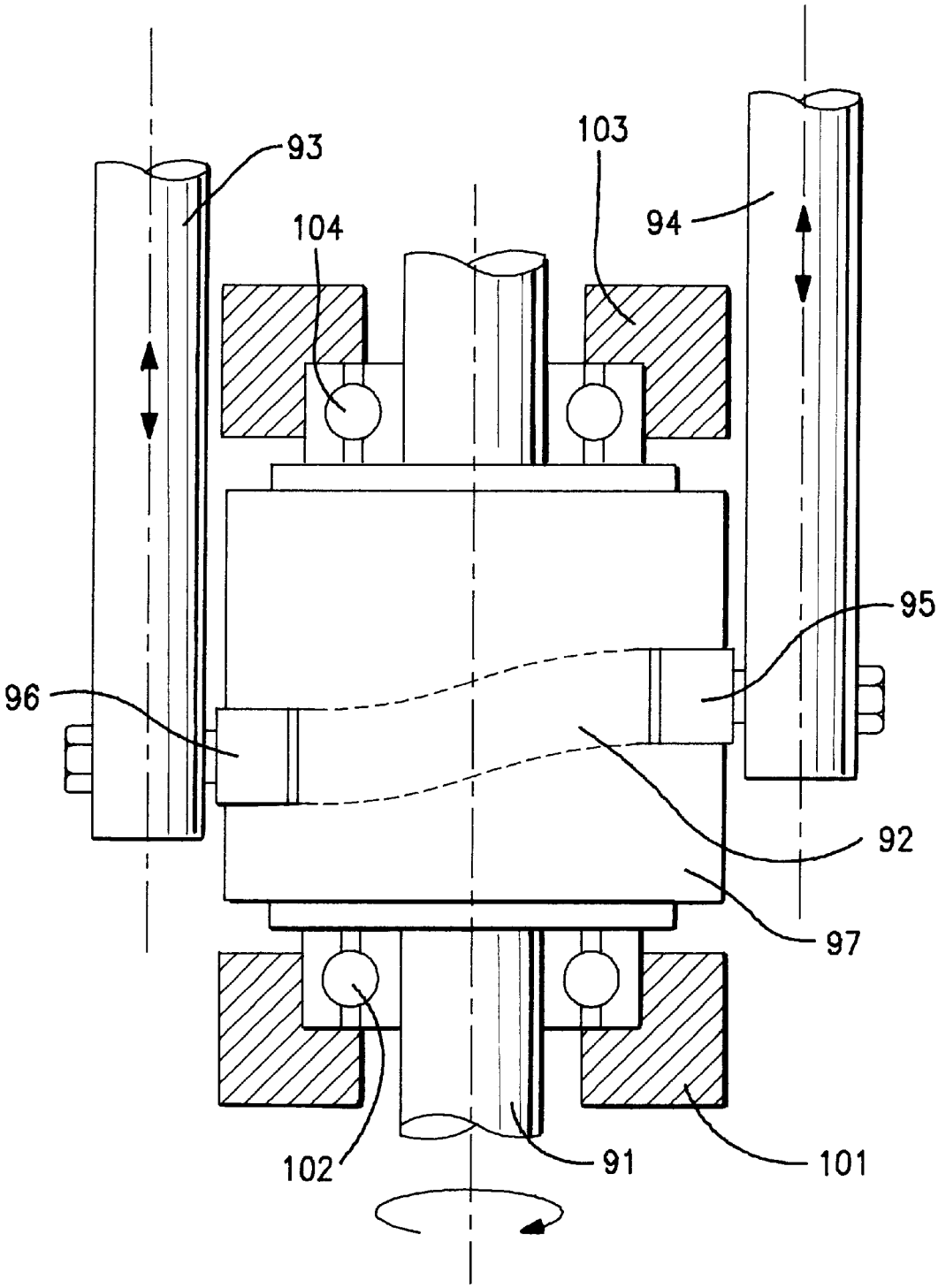
FIG. 26 is a view illustrative of a cam mechanism used as a controller for controlling a reciprocal movement of double plungers in a fifth embodiment according to the present invention.

A fifth embodiment according to the present invention will be described in detail with reference to FIG. 26, a pulsation free pump is provided, which has the same structure as in the first embodiment, except for the controller mechanism which controls the reciprocal movements of double plungers 93, 94, for which reason the description will focus only on the controller mechanism.

Double cam followers 95 and 96 are mechanically connected to the plungers 94 and 93 respectively. The cam followers 95 and 96 are movable in a predetermined direction represented by arrow marks so that displacements of the cam followers 95 and 96 in the predetermined direction cause corresponding displacements of the plungers 94 and 93. A single cam rotary shaft 91 is provided which rotates on a fixed axis parallel to the predetermined direction cause corresponding displacements of the plungers 94 and 93. A single cam rotary shaft 91 is provided which rotates on a fixed axis parallel to the predetermined direction at a predetermined constant rotation speed. A single cylindrically shaped cam 97 is provided which is rotatable in a plane vertical to the fixed axis of the single cam rotary shaft 91. The single cylindrically shaped cam 97 has a rotation center which is mechanically connected to the single cam rotary shaft 91. The single cam rotary shaft 91 is supported by first and second bearings 102 and 104 which are positioned at both sides of the cam 97. The first and second bearings 102 and 104 are further supported by first and second housings 101 and 103. A cylindrical side face of the single cylindrically shaped cam 97 has an annular guide groove 92 receiving the cam followers 95 and 96 to engage the single cylindrically shaped cam 97 with the cam followers 95 and 96. The annular guide groove 92 of he single cylindrically shaped cam 97 varies in level parallel to the fixed axis over a rotation angle of the single cylindrically shaped cam 97 so that as the rotation angle is increased, the level of the annular guide groove continuously drops to a bottom level to provide the suction process and then slightly rises from the bottom level to provide the pressure-rising process before the level of the annular guide groove 92 continuously rises up to a top level to provide the discharge process.

Figure 27:
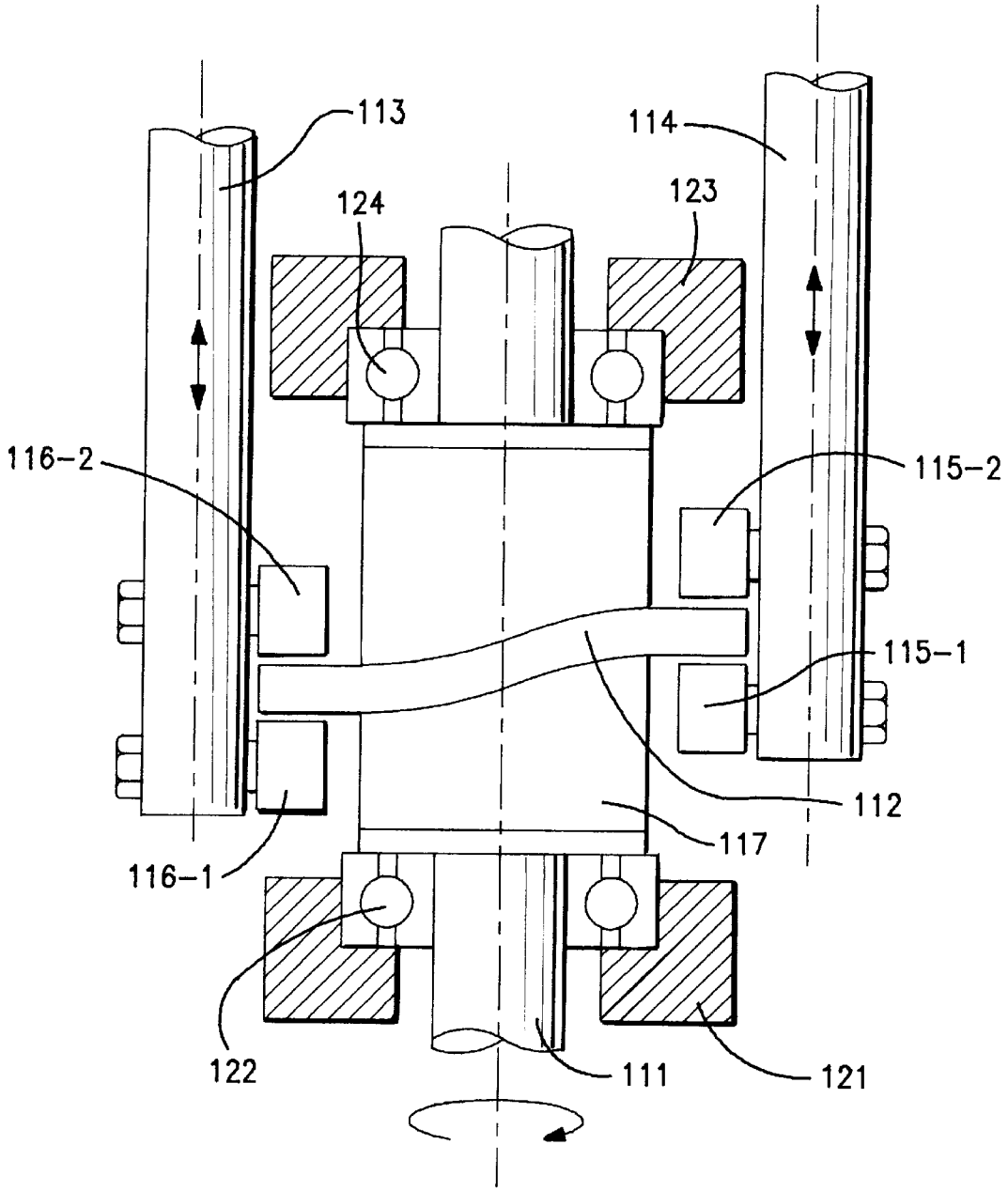
FIG. 27 is a view illustrative of a cam mechanism used as a controller for controlling a reciprocal movement of double plungers in a sixth embodiment according to the present invention.

A sixth embodiment according to the present invention will be described in detail with reference to FIG. 27, a pulsation free pump is provided, which has the same structure as in the first embodiment, except for the controller mechanism which controls the reciprocal movements of double plungers 113, 114, for which reason the description will focus only on the controller mechanism.

Two pairs of cam followers 115-1, 115-2, 116-1 and 116-2 are mechanically connected to the plungers 114 and 113 respectively. The cam followers 115-1, 115-2, 116-1 and 116-2 are movable in a predetermined direction so that displacements of the cam followers 115-1, 115-2, 116-1 and 116-2 in the predetermined direction cause corresponding displacements of the plungers 114 and 113. A single cam rotary shaft 111 is provided which rotates on a fixed axis parallel to the predetermined direction at a predetermined constant rotation speed. A single cylindrically shaped cam 117 is provided which is rotatable in a plane vertical to the fixed axis of the single cam rotary shaft 111. The single cam rotary shaft 111 is supported by first and second bearings 122 and 124 which are positioned at both sides of the cam 117. The first and second bearings 122 and 124 are further supported by first and second housings 121 and 123. The single cylindrically shaped cam 117 has a rotation center which is mechanically connected to the single cam rotary shaft 111. A cylindrical side face of the single cylindrically shaped cam 117 has an annular rim 112 engaged with the cam followers 115-1, 115-2, 116-1 and 116-2 to engage the single cylindrically shaped cam 117 with the cam followers 115-1, 115-2, 116-1 and 116-2. The annular rim 112 of the single cylindrically shaped cam 117 varies in level parallel to the fixed axis represented by the broken line over a rotation angle of the single cylindrically shaped cam 117 so that as the rotation angle is increased, the level of the annular rim 112 continuously drops to a bottom level to provide the suction process and then slightly rises from the bottom level to provide the pressure-rising process before the level of the annular rim 112 continuously rises up to a top level to provide the discharge process.

Figure 28:
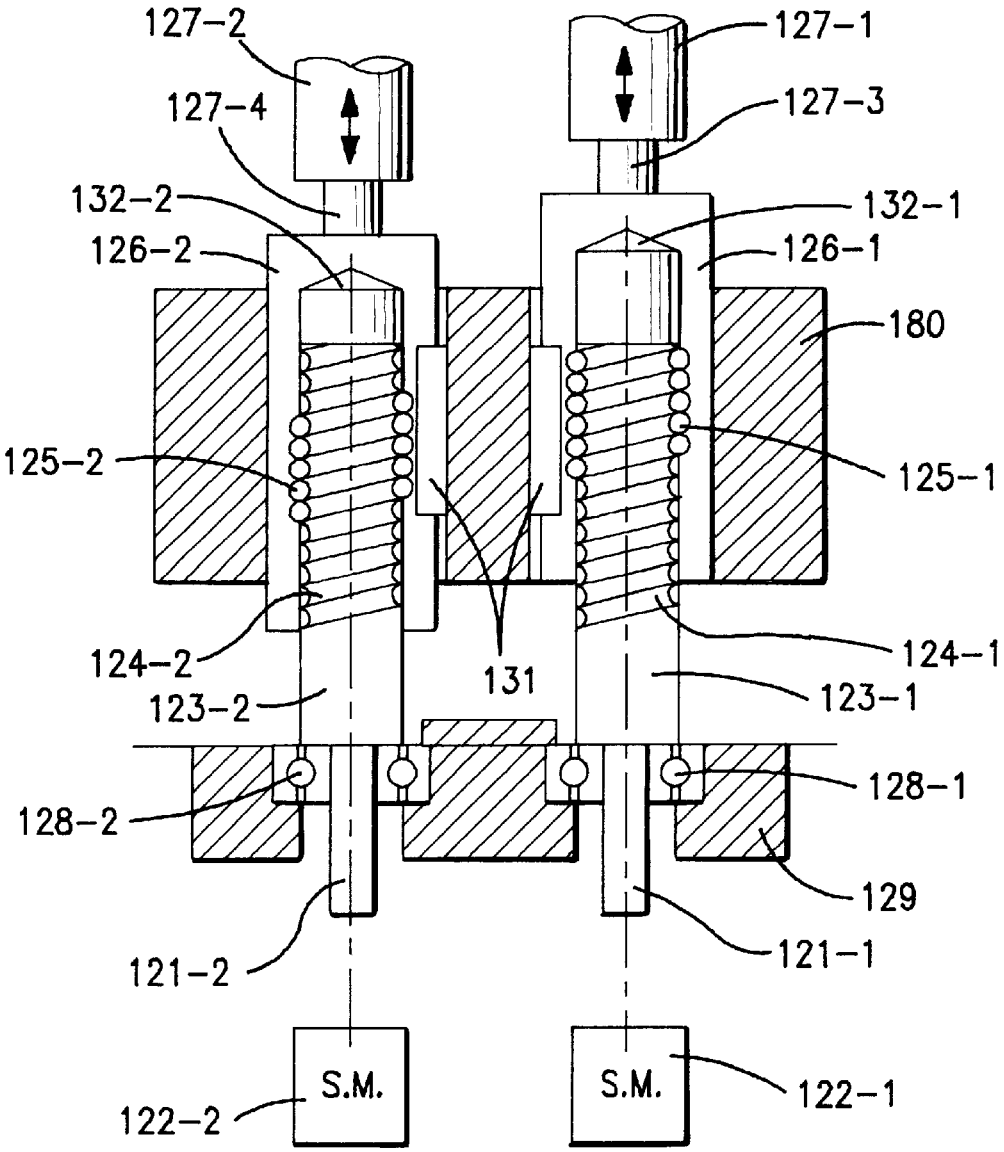
FIG. 28 is a view illustrative of a cam mechanism used as a controller for controlling a reciprocal movement of double plungers in a seventh embodiment according to the present invention.

A seventh embodiment according to the present invention will be described in detail with reference to FIG. 28, a pulsation free pump is provided, which has the same structure as in the first embodiment, except for the controller mechanism which controls the reciprocal movements of double plungers 127-1, 127-2, for which reason the description will focus only on the controller mechanism.

Double driving motors 122-1 and 122-2 are provided which correspond to the plungers 127-1, 127-2. Each of the driving motors 122-1 and 122-2 is capable of bi-direction variable-speed rotations. The driving motors 122-1 and 122-2 is capable of bi-directional variable-speed rotations.

The driving motors 122-1 and 122-2 may comprise stepping motors. Double rotary-to-linear motion converters are mechanically connected at one end thereof to the driving motors and also mechanically connected at the opposite end thereof to the plungers. Each of the rotary-to-linear motion converters convert bi-directional variable-speed linear motions of the plunger so that the rotary-to-linear motion converter makes the plunger vary in displacement in accordance with rotation angle of the driving motor. The rotary-to-linear motion converters may comprise cylinders 126-1 and 126-2 which are mechanically connected to the plungers 127-1 and 127-2 via rods 127-3 and 127-7 and capable of bi-directional linear motions along with the plungers 127-1 and 127-2. The cylinders 126-1 and 126-2 have cylindrically shaped inner walls 132-1 and 132-2 which are further formed thereon with first helical ball spline grooves receiving ball bearings 125-1 and 125-2 respectively. Screws 123-1 and 123-2 are mechanically connected through rotary shafts 121-1 and 121-2 to the stepping motors 122-1 and 122-2 and are capable of bi-directional rotary motions. The rotary shafts 121-1 and 122-2 are supported by first and second bearings 128-1 and 128-2 which are supported by a first housing 129. The cylinders 126-1 and 126-2 are supported by a second housing 130 via sliding keys 131. The screws 123-1 and 123-2 have cylindrical side faces formed thereon with second helical ball spline grooves 124-1 and 124-2 receiving the ball bearings 125-1 and 125-2 respectively through which the screws 123-1 and -123-2 are mechanically engaged with the cylindrically shaped inner walls 123-1 and 123-2 of the cylinders 126-1 and 126-2 so that the bi-directional rotary motions of the screws 123-1 and 123-2 are converted into the bi-directional linear motions of the cylinders 127-1 and 127-2.

Figure 29:
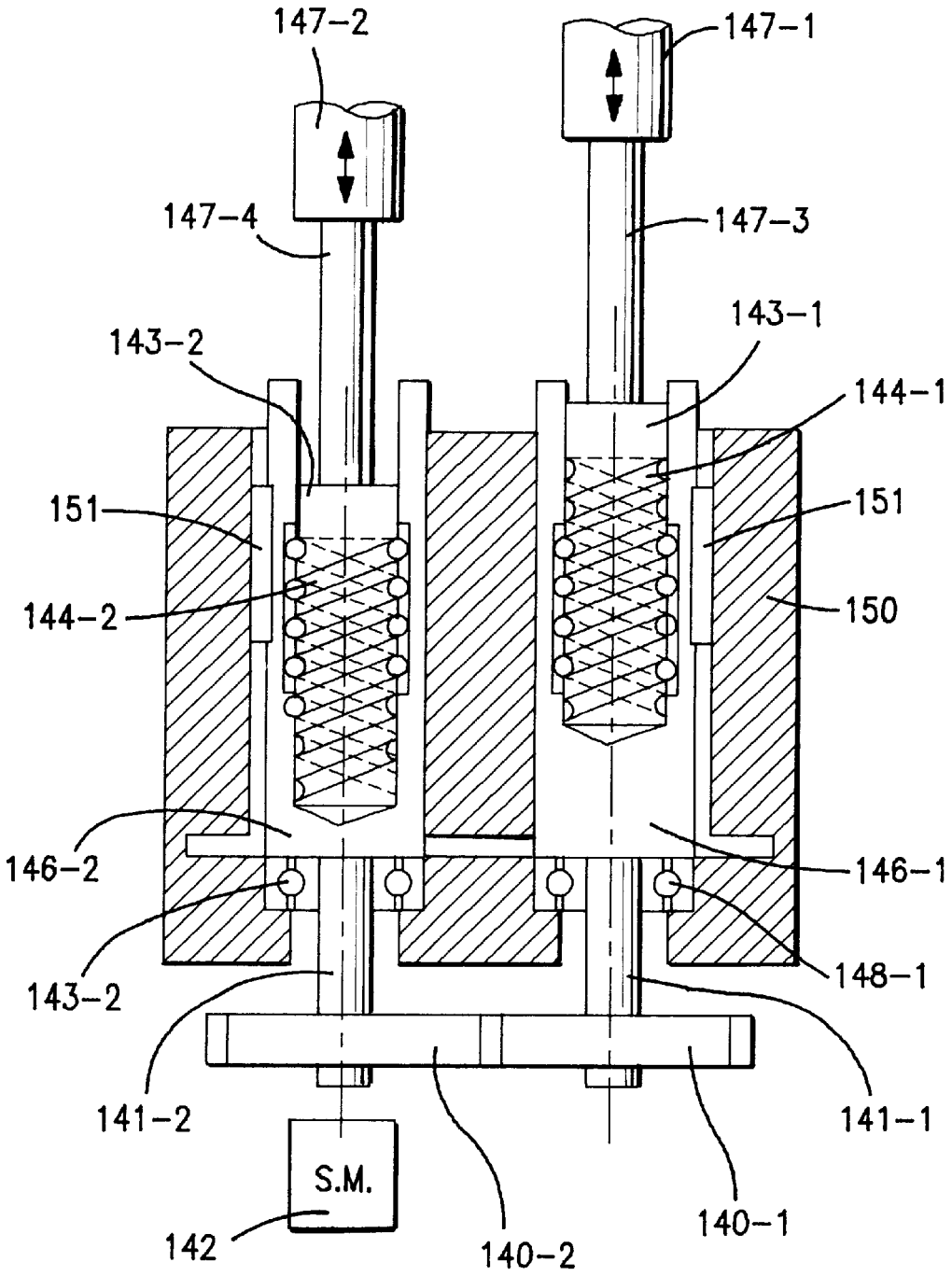
FIG. 29 is a view illustrative of a cam mechanism used as a controller for controlling a reciprocal movement of double plungers in a eighth embodiment according to the present invention.

An eight embodiment according to the present invention will be described in detail with reference to FIG. 29, a pulsation free pump is provided, which has the same structure as in the first embodiment, except for the controller mechanism which controls the reciprocal movements of double plungers 147-1, 147-2, for which reason the description will focus only on the controller mechanism.

A single driving motor 142 is provided which may comprise a stepping motor for allowing bi-directional variable-speed rotations. A transmission gear mechanism is provided which comprises first and second gears 140-1 and 1402 are mechanically engaged with the single driving motor 142. First and second rotary-to-linear motion converters are mechanically connected at one end thereof via the transmission gear mechanism to the single driving motor. The first and second rotary-to-linear motion converters may comprise cylinders 146-1 and 146-2 which are mechanically connected through the gear mechanism 140-1 and 140-2 to the stepping motor 142 for bi-directional rotary motions along with the stepping motor 142. The cylinders 146-1 and 146-2 have cylindrically shaped inner walls formed thereon with first helical ball spline grooves receiving ball bearings. Screws 143-1 and 143-2 are mechanically connected to the plungers 147-1 and 147-2 via roads 147-3 and 147-4 for bi-directional linear motions. The screws 143-1 and 143-2 have cylindrical side faces formed thereon with second helical ball spline grooves 144-1 and 144-2 receiving the ball bearings through which the screws 143-1 and 143-2 are mechanically engaged with the cylindrically shaped inner wall of the cylinder so that the bi-directional rotary motions of the cylinders 147-1 and 147-2 are converted into the bi-directional linear motions of the screws 143-1 and 143-2.

The first and second rotary-to-linear motion converters as described above convert variable-speed rotary motions in different directions from each other into variable-speed linear motions of the first and second plungers 147-1 and 147-2 in opposite directions to each other so that the first and second rotary-to-linear motion converters make the first and second plungers 147-1 and 147-2 vary in displacement in opposite directions to each other according to rotation angle of the driving motor 142. The single driving motor 142 rotates in a first direction at variable speeds so as to make a displacement of the first plunger 147-1 continuously decrease to a minimum displacement thereby providing the suction process and simultaneously make a displacement of the second plunger 147-2 continuously increase up to a maximum displacement thereby providing the discharge process. Subsequently, the single driving motor 142 is reversed to slightly rotate in a second direction so as to make the displacement of the first plunger 147-1 slightly increase from the minimum displacement thereby providing the pressure-rising process and simultaneously make the displacement of the second plunger 147-2 slightly decrease from the maximum displacement thereby providing a pressure-dropping process, before the driving motor 142 remains rotating in the second direction at variable speeds so as to make the displacement of the first plunger 147-1 continuously increase up to a maximum displacement thereby providing the discharge process and simultaneously make the displacement of the second plunger 147-2 continuously decrease to a minimum displacement thereby providing the suction process. Thereafter, the single driving motor 142 is reversed to slightly rotate again in the first direction so as to make the displacement of the first plunger 142-1 slightly decrease from the maximum displacement thereby providing the pressure-dripping process and simultaneously make the displacement of the second plunger 142-2 slightly increase from the minimum displacement thereby providing a pressure-rising process.

As a modification, a differential pressure automatic air extraction mechanism may be provided as illustrated in FIGS. 16, 17A, 17B and 18. A ball valve 30, an amount of the oil to be discharged together with the air generated in the hydraulic chamber 44 is slight as compared to the pump discharge flow rate. As a result, the pump discharge operation is not interrupted, but a small variation in the flow rate is a serious problem with the pulsation pump. In the initiation of the discharge operation, the pump chamber 46 and the hydraulic chamber 44 are subjected to change from the negative to positive pressure and therefore the pressures thereof are raised up to a pressure of the oil feeder pipe at the discharge side thereby the check valve at the discharge side is opened through which the liquid is discharged. Accordingly, a pressured air resides at least one of the hydraulic chamber 44 and the pump chamber 46, even when the plunger moves, no liquid is discharged until the air is compressed up to the discharge pressure. An increase in a rifting amount L of the ball 32 of the above differential pressure automatic air extraction ball valve 30 may lead to an increase in discharge flow rate of the oil from the hydraulic chamber 44. Adjusting the rifting amount of the ball 32 may adjust the pump discharge flow rate. This may allow a mechanical adjustment of the reduction in the pump discharge flow rate thereby readily preventing the pulsation of the composite discharge flow rate when the discharge initiation.

Similarly, in the above multi-function valve 60*a* for the air extraction and the oil supplement may be adjusted to increase a pressure difference generated at the flow rate adjuster 86 through which the pressured oil passes discontinuously by the piston pump 72 thereby oil discharge flow rate from the hydraulic chamber 44 is increased. It has been found out that a magnitude of the reduction of the discharge flow rate may be mechanically adjusted to prevent any pulsation of the composite discharge flow rate in the initiation of the discharge operation.

The present invention provides a pulsation free pump with a pulsation adjustable feature. The pump comprises a plurality of hydraulic diaphragm pumps arranged in parallel to each other or in series to be driven with cams in predetermined phase differences. A waveform of a composite discharge flow rate of the above a plurality of pumps is always kept constant. For the purpose of compensation for a reduction of the discharge flow rate in the initiation of the discharge process, the cams are so shaped that a pre-discharge process is made at a predetermined discharge flow rate prior to the original discharge process to set the discharge flow rate at zero in the initiation of the original discharge process so that the actual discharge composite discharge flow rate corresponds to the original discharge flow rate.

The above pump is characterized in that a slight amount of the discharge of the liquid in the pre-discharge process is set larger than a maximum of the reduction in amount of the discharge of the liquid in the pre-discharge process and an air extraction valve of the hydraulic diaphragm pump is arranged to adjust an amount of an oil discharging together with the air extraction to thereby adjust a pump discharge flow rate so that the above slight amount of the reduction of the discharge oil is compensated by the variable reduction amount and the fixed increasing amount defined by the shape of the cam.

The above air extraction valve comprises a pressure difference ball valve placed within an oil reservoir provided on a top of the pump body to be connected to a hydraulic chamber of the diaphragm pump. There are provided top and bottom seats for the ball at upstream and downstream sides of the ball. The ball moves by a pressure difference between a pressure of the hydraulic chamber and an atmosphere. An amount of the rift of the ball is adjusted to adjust a leakage of the liquid through the ball.

The air extraction valve may comprise an air-extraction/oil-supplement valve placed within the oil reservoir provided on the top of the pump body to be connected to the hydraulic chamber of the hydraulic diaphragm pump. The piston pump shows pump operations synchronized with motions of the plunger for operation of the diaphragm pump to place the valve in forcible opening and closing operations. Opening and closing duration of the valve are adjusted to adjust a leakage amount of the oil from the valve.

According to the present invention, the hydraulic diaphragm pump is so constituted that the automatic air extractor causes, during the air extraction process, a pressure oil or a diaphragm operation oil discharge together with an air from the hydraulic chamber and fed into the oil reservoir. The reduction during the air extraction of the pump discharge flow rate is due to the residual air in the hydraulic driving section, the leakage during the air extraction and the residual air in the pump operating section. Those problems may be taken care of by the same manner as the problems in the reductions due to the clearance of the driving section and the leakage from the check valve. For that reason, the pulsation variable according to the pump operation, conditions may be readily and mechanically adjusted at the minimum by adjusting the variable reductions of the discharge flow rate via the reduction due to the air extraction, namely by compensations from the increase of the discharge flow rate by the reduction during the air extraction.

The above increment $\Delta q3$ of the discharge flow rate according to the present invention is different from the increment $\Delta q1$ of the discharge flow rate of the conventional pump. The increment $\Delta q3$ is for compensation for the variable decrement $\Delta q2'$ of the decrease $\Delta q2$ of the pump discharge flow rate. The automatic air extractor 20 is arranged to adjust the air extraction operation for compensation of the above increment $\Delta q3$ via the air extraction.

The decrement $\Delta q2$ of the pump discharge flow rate may be given by the following equation.

$$\Delta q2=\Delta q2'+\Delta q2'' \quad (1)$$

Where $\Delta q2'$ is the variable decrement and $\alpha q2''$ is the adjustable decrement.

The increment $\Delta q3$ is given by the following equation.

$$\Delta q3=\Delta 2 \quad (2)$$

Where $\Delta q3$ is the increment of the discharge flow rate due to compensation in the shape of the cam.

Figure 16:
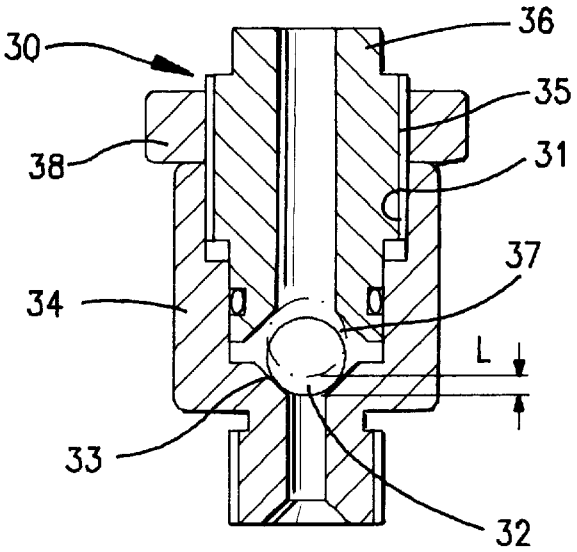
FIG. 16 is a cross sectional elevation view illustrative of a structure of a pressure difference ball automatic air extraction valve applicable to a pulsation free pump of FIGS. 13 and 14.
Figure 17A:
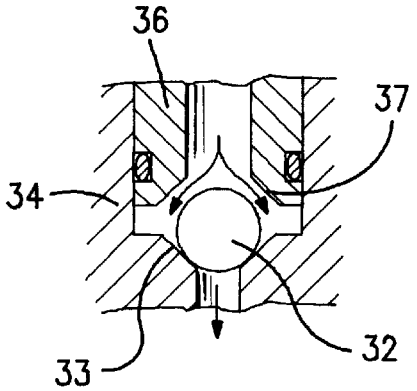
FIGS. 17A and 17B are cross sectional elevation view illustrative of a pressure difference ball automatic air extraction valve wherein a ball is positioned at a top and a bottom.
Figure 17B:
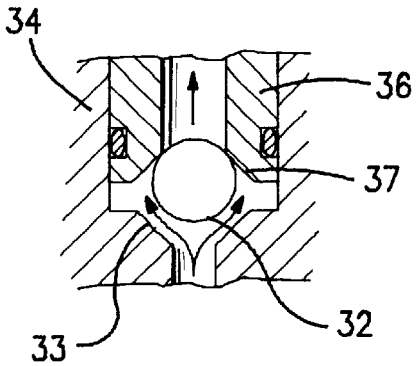

The air extractor 20 may comprise a pressure difference ball air extraction valve 30 as illustrated in FIG. 16. An amount L of the rift of the ball 32 may be adjusted by adjusting in screw an adjusting nut 31 of the ball body 34 and the adjustable pipe 35. The automatic air extraction valve 30 may be adjusting the decrement of the decrement of the pump discharge flow rate. FIGS. 17A and 17B illustrate the automatic air extraction valve. In the initiation of the suction process, the ball moves from the top to bottom and thereby the ball 32 is engaged with the bottom seat for suction of a slight amount of the oil as illustrated in FIG. 17A. In the initiation of the discharge process, the ball 32 moves from a bottom to a top for discharge of a slight amount of the pressured oil. The discharge flow rate is set larger than the suction flow rate on the ground that the difference in pressure of the interior of the pump from atmosphere during the discharge process is larger than that during the suction process.

The air generated in the hydraulic chamber 44 is discharged together with the pressured oil by the automatic air extraction valve 30. The amount of the discharged oil is very slight as compared to the pump discharge amount thereby the oil discharge in the air extraction provides no influence to the pump discharge function.

Such slight variation of the discharge flow rate is, however, a serious problem with the pulsation free pump. At the initiation of the pump discharge process, pressures of the hydraulic chamber 44 and the pump chamber 46 are changed from a negative pressure to a positive pressure thereby the pressure is raised up to the same level as the pipelines at the discharge side. As a result, a check valve is made open for discharge of the liquid. If a pressured air resides in a liquid of at least any one of the hydraulic chamber 44 and the pump chamber 46, no liquid is discharged even the plunger is operated until the air pressure is raised up to the discharge pressure.

Figure 18:
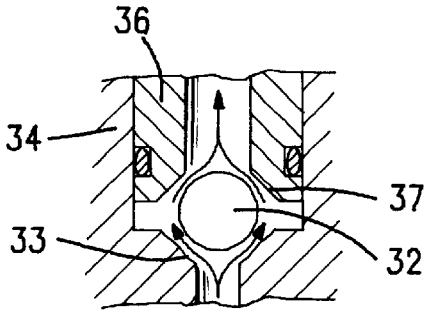
FIG. 18 is a cross sectional elevation view illustrative of a pressure difference ball automatic air extraction valve wherein a ball is positioned at an intermediate position.

When the amount L of the rift of the ball 32 in the automatic air extraction valve 30 is increased as illustrated in FIG. 18, the discharge flow rate of the oil from the automatic air extraction valve 30 increased for compensation for the reduction of the pump discharge flow rate.

No change in the pump discharge flow rate appears during the interruption of the pump discharge operation. When the reduction of the pump discharge flow rate is adjusted by adjusting the rift L of the ball 32 of the automatic air extraction valve 30, an adjustable amount $\Delta Q$ ($\Delta q2''$) thereof is given by a difference of the variable decrement (Δg2') from the increment (Δq3) due to the compensation in shape of the cam.

$$\Delta Q=\Delta q3-\Delta 2' \quad (3)$$

Figure 15:
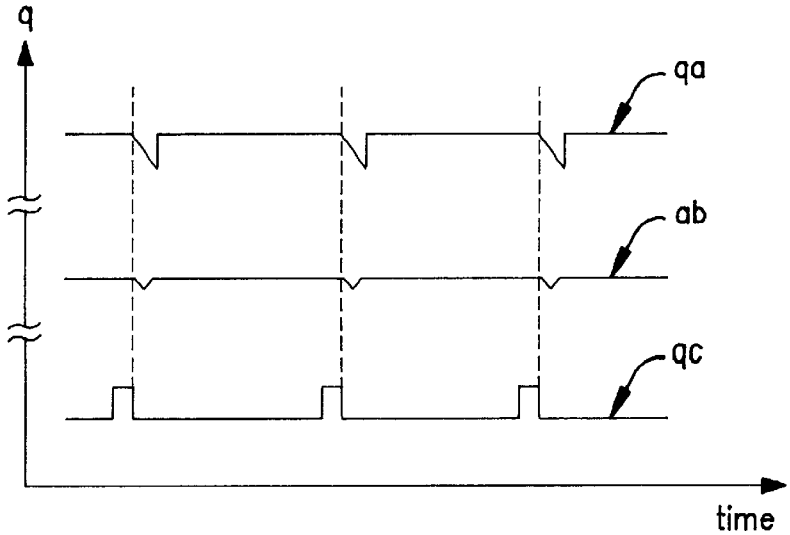
FIG. 15 is a diagram illustrative of waveforms of a composite discharge flow rate associated with a pulsation free pump of FIG. 13.

In FIG. 15, when the composite discharge flow rate is represented by a waveform qa wherein the decrement Δq2 of the pump discharge flow rate is larger than the increment Δq3 of the pump discharge flow rate, the adjustable amount ΔQ is reduced to reduce the decrement Δq2 of the pump discharge flow rate for the compensation for the increment Δq3 of the pump discharge flow rate so that the waveform qa may be adjusted into a pulsation free waveform qb.

When the discharge flow rate has a waveform represented by qc wherein the increment Δq3 of the pump discharge flow rate is larger than the decrement Δq2 of the pump discharge flow rate, the adjustable amount ΔQ is increased to increase the decrement Δq3 of the pump discharge flow rate for compensation for the increment Δq3 of the pump discharge thereby the waveform qc is made into a pulsation free waveform With respect to setting the increment Δq3 of the pump discharge flow rate, the decrement Δq2 of the pump discharge flow rate is given by Δq2=Δq2'+Δq2". The above increment Δq3 set would substantially be an initial discharge thereby the decrement Δq2 is generated. Accordingly, the increment Δq3 is given by the following equation.

$$\Delta q3=\Delta q2=\Delta q2'+\Delta q2'' \quad (4)$$

In the automatic air extraction hydraulic diaphragm pump, the increment of the discharge flow rate is set for compensation for the decrement of the pump discharge flow rate. The automatic air extractor shows an adjustable air extraction operation to achieve the required compensation so that the pulsation due to the various pump operation condition is suppressed.

Figure 14:
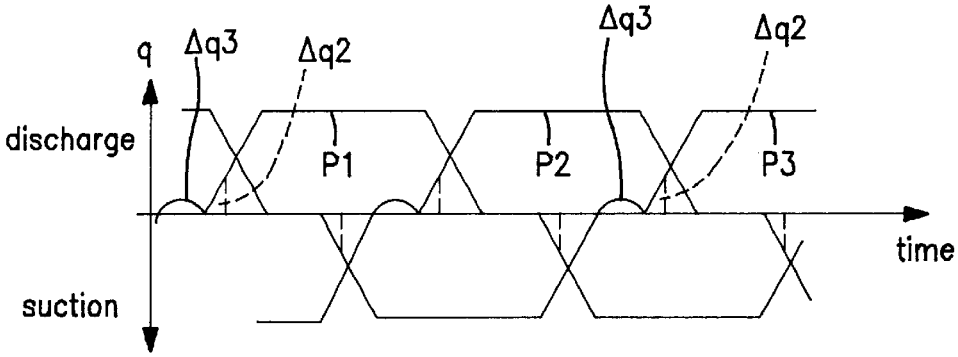
FIG. 14 is a diagram illustrative of waveforms of a pump discharge flow rate of a pulsation free pump provided with a pulsation adjustable feature in another example according to the present invention.

FIG. 14 is illustrative of waveforms of the discharge flow rate associated with pulsation free pumps of another embodiment according to the present invention. The structure of the pump of this embodiment is the same as that of the foregoing embodiment, except that the pulsation free pump comprises three automatic air extraction hydraulic diaphragm pumps P1, P2 and P3 and the cam driving is carried out at a phase difference of 120°.

Figure 11A:
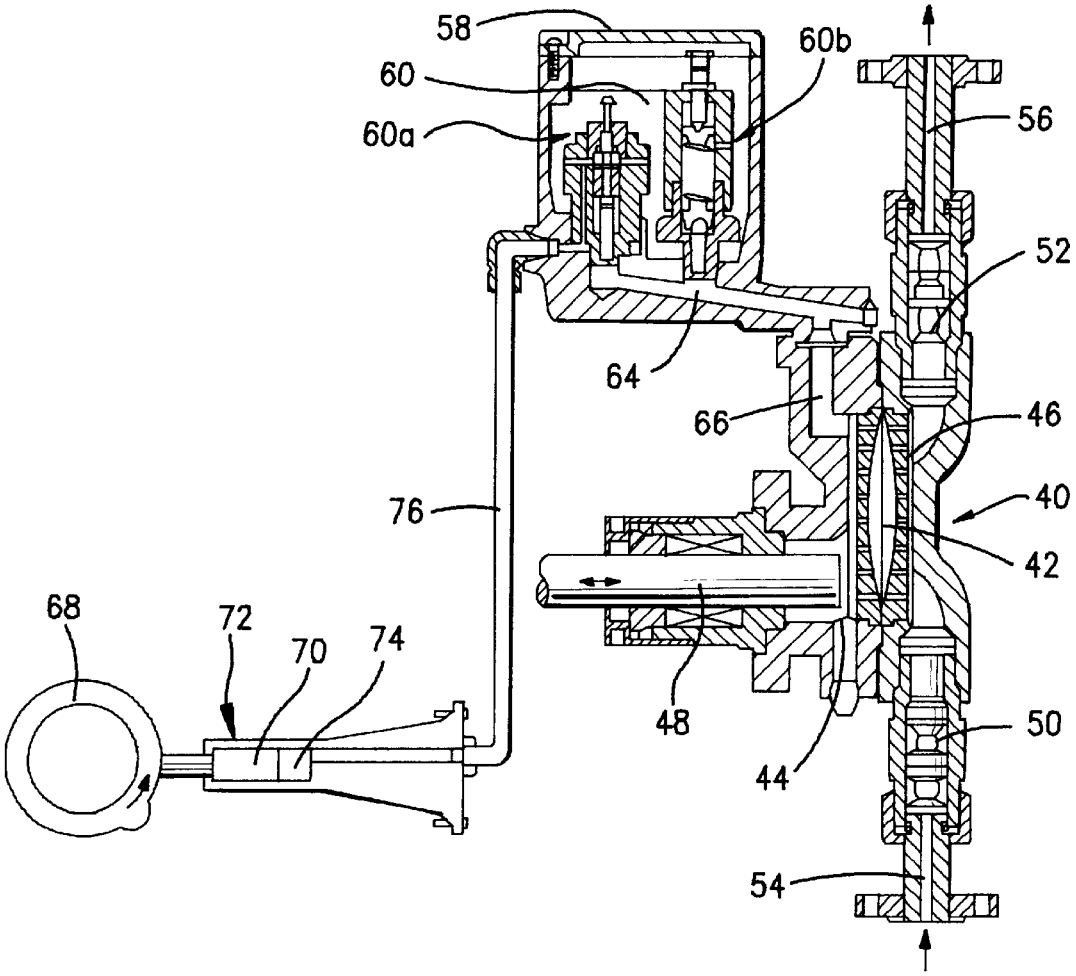
FIG. 11A PRIOR ART
FIG. 11A is a fragmentary cross sectional elevation view illustrative of an automatic air extraction diaphragm pump.
Figure 11B:
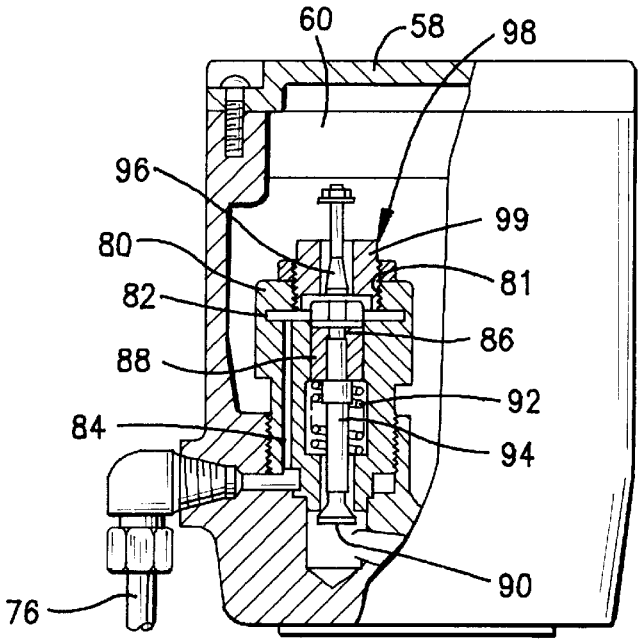
FIG. 11B PRIOR ART
FIG. 11B is a cross sectional view illustrative of an air-extraction/oil-supplement valve provided in an oil reservoir.
Figure 12:
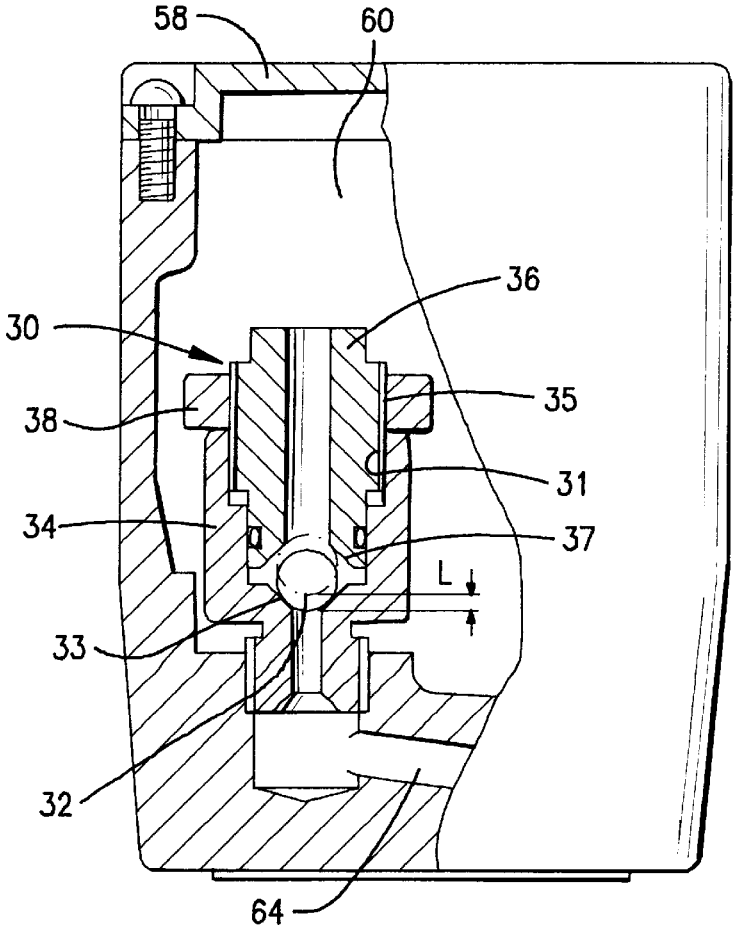
FIG. 12 PRIOR ART
FIG. 12 is a cross sectional view illustrative of a pressure difference ball automatic air extraction valve provided in an oil reservoir.
Figure 13:
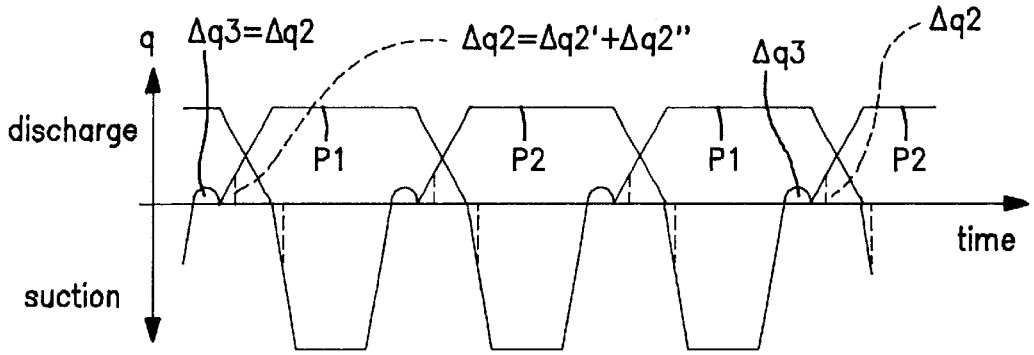
FIG. 13 is a diagram illustrative of waveforms of a pump discharge flow rate of a pulsation free pump provided with a pulsation adjustable feature in an example according to the present invention.

Such pump may be useful when an air-extraction/oil-supplement valve 60*a* is used as illustrated in FIG. 11B. In the air-extraction/oil-supplement valve 60*a*, the valve body 80 forming the pressure chamber 82 is coupled via a screw 81 to a member 99 constituting a valve 98 provided adjacent the pressure chamber 82 through which the plunger 94 with a tapered portion 96 penetrates. The member 99 is screwed adjustably to reduce the capacitor of the pressure chamber 82 and to adjust the flow rate adjustable section 86 control the flow rate for a long duration of opening and closing states of the valve to increase the leakage of the oil from the valve.

The increment of the pump discharge flow rate is set for compensation for the decrement of the pump discharge flow rate. The automatic air extractor shows an adjustable air extraction operation to achieve the required compensation so that the pulsation due to the various pump operation condition is suppressed.

Whereas modifications of the present invention will be apparent to a person having ordinary skill in the art, to which the invention pertains, it is to be understood that the embodiments shown and described by way of illustrations are by no means intended to be considered in a limiting sense. Accordingly, it is to be intended to cover by claims all modifications of the present invention which fall within the spirit and scope of the invention.

What is claimed is:

1. A pulsation free pump comprising:

a plurality of hydraulic diaphragm pumps;

a plurality of plungers provided to correspond to said hydraulic diaphragm pumps, each of said plungers performing a reciprocal movement which provides a pumping cycle operation corresponding to one of said plurality of hydraulic diaphragm pumps, each of the pumping cycles comprising a discharge process and a subsequent suction process; and means for controlling reciprocal movements of said plungers in association with each other at a predetermined difference in phase of the pumping cycle, said diaphragm pump comprising a hydraulic diaphragm pump provided with an air exhaust differential pressure regulating valve which operates in accordance with a difference in pressure between an external atmospheric pressure and a liquid in a pump chamber of said hydraulic pump so that in said discharge process not on said liquid but also an air in said sump chamber are exhausted from said pump chamber by a large pressure difference through said air exhaust differential pressure regulating valve whilst in said subsequent suction process only said liquid is returned in said pump chamber so as to exhaust the air in said pump chamber, said air exhaust differential pressure regulating valve comprising a ball valve movable between an upstream valve seat positioned near said pump chamber at an upstream side and a downstream valve seat positioned far from said pump chamber so that in said discharge process said ball valve is made to securely contact with said downstream valve seat whilst in said subsequent suction process said ball valve is made to securely contact with said upstream valve seat, a distance between said upstream valve seat and said downstream valve seat being adjustable to adjust an amount of said liquid exhausted from said pump chamber in said discharge process, wherein said means for controlling reciprocal movements of said plungers controls said reciprocal movement of each of said plungers so as to set a preliminary pressure-rising process just before said discharge process so that a discharge flow rate of each of said diaphragm pumps is initiated to increase without any time delay when said pumping cycle enters into said discharge process whereby a total discharge flow rate defined by the sum of said discharge flow rates of all of said plungers is kept constant and free of any substantial pulsation.

2. The pulsation free pump as claimed in claim 1, wherein said discharge process further comprises:

a uniformly and positively accelerated motion period during which a discharge flow rate of each of said plungers uniformly increases from zero to a positive value;

a positive uniform motion period during which the increased discharge flow rate of each of said plungers remains unchanged at said positive value; and a uniformly and negatively accelerated motion period during which the discharge flow rate of each of said plungers uniformly decreases from said positive value to zero;

wherein said means for controlling reciprocal movements of said plungers is designed and adapted so that when one of said plural hydraulic diaphragm pumps operates at said positive value the remaining of said plural hydraulic diaphragm pumps operate at less than said positive value.

3. The pulsation free pump as claimed in claim 1 wherein said means for controlling reciprocal movements of said plungers is a cam mechanism which comprises:

a plurality of cam followers mechanically connected to said plungers, said cam follower being movable in a predetermined direction so that a displacement of said cam follower in said predetermined direction causes a corresponding displacement of said plunger;

a single cam rotary shaft rotating on a fixed axis vertical to said predetermined direction at a predetermined constant rotation speed; and a plurality of disk-like cams provided corresponding to said plungers, said disk-like cams being rotatable in a plane vertical to said fixed axis of said single cam rotary shaft, said disk-like cams having rotation centers being mechanically connected to said single cam rotary shaft so as to have a predetermined phase difference from each other, and each of said disk-like cams having a peripheral side edge always in contact with said cam follower, wherein said peripheral side edge of each of said disk-like cams varies in distance from said rotation center over a rotation angle of said disk-like cam so that as said rotation angle is increased, said distance from said rotation center continuously decreases to a minimum distance to provide said suction process and then slightly increases from said minimum distance to form a hillock on said peripheral side edge of said disk-like cam so as to provide said pressure-rising process before said distance continuously increases up to a maximum distance to provide said discharge process.

4. The pulsation free pump as claimed in claim 1, wherein said means for controlling reciprocal movements of said plungers is a cam mechanism which comprises:

a plurality of cam followers mechanically connected to said plungers, said cam follower being movable in a predetermined direction so that a displacement of said cam follower in said predetermined direction causes a corresponding displacement of said plunger;

a single cam rotary shaft rotating on a fixed axis vertical to said predetermined direction at a predetermined constant rotation speed; and a plurality of disk-like cams provided corresponding to said plungers, said disk-like cams being rotatable in a plane vertical to said fixed axis of said single cam rotary shaft, said disk-like cams having rotation centers being mechanically connected to said single cam rotary shaft so as to have a predetermined phase difference from each other, and one surface of each of said disk-like cams having an annular guide groove receiving said cam follower to engage said disk-like cam with said cam follower, wherein said annular guide groove of each of said disk-like cams varies in distance from said rotation center over a rotation angle of said disk-like cam so that a s said rotation angle is increased, said distance from said rotation center continuously decreases to a minimum distance to provide said suction process and then slightly increases from said minimum distance so as to provide said pressure-rising process before said distance continuously increases up to a maximum distance to provide said discharge process.

5. The pulsation free pump as claimed in claim 1, wherein said means for controlling reciprocal movements of said plungers is a cam mechanism which comprises:

a pair of cam followers mechanically connected to two of said plungers respectively, said cam follower being movable in a predetermined direction so that a displacement of said cam follower in said predetermined direction causes a corresponding displacement of said plunger;

a single cam rotary shaft rotating on a fixed axis vertical to said predetermined direction at a predetermined constant rotation speed; and a single disk-like cam rotatable in a plane vertical to said fixed axis of said single cam rotary shaft, said single disk-like cam having a rotation center being mechanically connected to said single cam rotary shaft and said single disk-like cam having a peripheral side edge always in contact with said paired cam followers at radially opposite ends so that said paired cam followers and said rotation center of said single disk-like cam are aligned on a straight line to provide a 180° phase difference bet ween said plungers, wherein said peripheral side edge of said single disk-like cam varies in distance from said rotation center over a rotation angle of said disk-like cam so that as said rotation angle is increased, said distance from said rotation center continuously decreases to minimum distance to provide said suction process and then slightly increases from said minimum distance to form a hillock on said peripheral side edge of said disk-like cam so as to provide said pressure-rising process before said distance continuously increases up to a maximum distance to provide said discharge process.

6. The pulsation free pump as claimed in claim 1, wherein said means for controlling reciprocal movements of said plungers is a cam mechanism which comprises:

a plurality of cam followers mechanically connected to said plungers, said cam follower being movable in a predetermined direction so that a displacement of said cam follower in said predetermined direction causes a corresponding displacement of said plunger;

a single cam rotary shaft rotating on a fixed axis parallel to said predetermined direction at a predetermined constant rotation speed; and a single disk-like cam rotatable in a plane vertical to said fixed axis of said single cam rotary shaft, said single disk-like cam having a rotation center being mechanically connected to said single cam rotary shaft, and one surface of said single disk-like cam having an annular ridge projecting in parallel to said fixed axis of said single cam rotary shaft so that a top surface of said annular ridge is always in contact with said cam followers, wherein said annular ridge of said single disk-like cam varies in height over a rotation angle of said disk-like cam so that as said rotation angle is increased, said height of said annular ridge continuously decreases to a minimum height to provide said suction process and then slightly increases from said minimum height to form a hillock on said top surface of said annular ridge so as to provide said pressure-rising process before said height continuously increases up to a maximum height to provide said discharge process.

7. The pulsation free pump as claimed in claim 1, wherein said means for controlling reciprocal movements of said plungers is a cam mechanism which comprises:

a plurality of cam followers mechanically connected to said plungers, said cam follower being movable in a predetermined direction so that a displacement of said cam follower in said predetermined direction causes a corresponding displacement of said plunger;

a single cam rotary shaft rotating on a fixed axis parallel to said predetermined direction at a predetermined constant rotation speed; and a single cylindrically shaped cam rotatable in a plane vertical to said fixed axis of said single cam rotary shaft, said single cylindrically shaped cam having a rotation center being mechanically connected to said single cam rotary shaft, and a cylindrical side face of said single cylindrically shaped cam having an annular guide groove receiving said cam follower to engage said single cylindrically shaped cam with said cam followers, wherein said annular guide groove of said single cylindrically shaped cam varies in level parallel to said fixed axis over a rotation angle of said single cylindrically shaped cam so that as said rotation angle is increased, said level of said annular guide groove continuously drops to a bottom level to provide said suction process and then slightly rises from said bottom level to provide said pressure-rising process before said level of said annular guide groove continuously rises up to a top level to provide said discharge process.

8. The pulsation free pump as claimed in claim 1, wherein said means for controlling reciprocal movements of said plungers is a cam mechanism which comprises:

a plurality of cam followers mechanically connected to said plungers, said cam follower being movable in a predetermined direction so that a displacement of said cam follower in said predetermined direction causes a corresponding displacement of said plunger;

a single cam rotary shaft rotating on a fixed axis parallel to said predetermined direction at a predetermined constant rotation speed; and a single cylindrically shaped cam rotatable in a plane vertical to said fixed axis of said single cam rotary shafts said single cylindrically shaped cam having a rotation center being mechanically connected to said single cam rotary shaft, and a cylindrical side face of said single cylindrically shaped cam having an annular rim engaged with said cam follower to engage said single cylindrically shaped cam with said cam followers, wherein said annular rim of said single cylindrically shaped cam varies in level parallel to said fixed axis over a rotation angle of said single cylindrically shaped cam so that as said rotation angle is increased, said level of said annular rim continuously drops to a bottom level to provide said suction process and then slightly rises from said bottom level to provide said pressure-rising process before said level of said annular rim continuously rises up to a top level to provide said discharge process.

9. The pulsation free pump as claimed in claim 8, wherein said annular rim is sandwiched between a pair of rollers which constitute each of said cam followers.

10. The pulsation free pump as claimed in claim 1, wherein said means for controlling reciprocal movements of said plungers comprises:

a plurality of driving motors provided corresponding to said plungers, each of said driving motors being capable of bi-directional variable-speed rotations;

a plurality of rotary-to-linear motion converters being mechanically connected at one end thereof to said driving motors and also mechanically connected at the opposite end thereof to said plungers, each of said rotary-to-linear motion converters converting bi-directional variable-speed rotary motions of said driving motor into bi-directional variable-speed linear motions of said plunger so that said rotary-to-linear motion converter makes said plunger vary in displacement in accordance with rotation angle of said driving motor, wherein said driving motor rotates in a first direction at variable speeds so as to make a displacement of said plunger from a reference position continuously decrease to a minimum displacement thereby providing said suction process and subsequently said driving motor is reversed to slightly rotate in a second direction so as to make said displacement of said plunger increase from said minimum displacement thereby providing said pressure-rising process before said driving motor remains rotating in said second direction at variable speeds so as to make displacement of said plunger continuously increase up to a maximum displacement thereby providing said discharge process.

11. The pulsation free pump as claimed in claim 10, wherein said driving motor comprises a stepping motor, and wherein each of said rotary-to-linear motion converters comprises:

a cylinder being mechanically connected to said plunger and capable of bi-directional linear motions along with said plunger, and said cylinder having a cyrindrically shaped inner wall formed thereon with first helical ball spline grooves receiving ball bearings; and a screw being mechanically connected to said stepping motor and capable of bi-directional rotary motions, said screw having a cylindrical side face formed thereon with second helical ball spline grooves receiving said ball bearings through which said screw is mechanically engaged with said cyrindrically shaped inner wall of said cylinder so that said bi-directional rotary motions of said screw are converted into said bi-directional linear motions of said cylinder.

12. The pulsation free pump as claimed in claim 10, wherein said driving motor comprises a stepping motor, and wherein each of said rotary-to-linear motion converters comprises:

a cylinder being mechanically connected to said stepping motor and capable of bi-directional rotate motions along with said stepping motor, and said cylinder having a cyrindrically shaped inner wall formed thereon with first helical ball spline grooves receiving ball bearings; and a screw being mechanically connected to said plunger and capable of bi-directional linear motions, said screw having a cylindrical side face formed thereon with second helical ball spline grooves receiving said ball bearings through which said screw is mechanically engaged with said cyrindrically shaped inner wall of said cylinder so that said bi-directional rotary motions of said cylinder are converted into said bi-directional linear motions of said screw.

13. The pulsation free pump as claimed in claim 1, wherein said plungers comprise first and second plungers and wherein said means for controlling reciprocal movements of said plungers comprises:

a single driving motor being capable of bi-directional variable-speed rotations;

a transmission gear mechanism being mechanically engaged with said single driving motor;

first and second rotary-to-linear motion converters being mechanically connected at one end thereof via said transmission gear mechanism to said single driving motor, said first and second rotary-to-linear motion converters being mechanically connected at the opposite end thereof to said first and second plungers respectively, said first and second rotary-to-linear motion converters converting variable-speed rotary motions in different directions from each other into variable-speed linear motions of said first and second plungers in opposite directions to each other so that said first and second rotary-to-linear motion converters make said first and second plungers vary in displacement in opposite directions to each other according to rotation angle of said driving motor, wherein said single driving motor rotates in a first direction at variable speeds so as to make a displacement of said first plunger continuously decrease to a minimum displacement thereby providing said suction process and simultaneously make a displacement of said second plunger continuously increase up to a maximum displacement thereby providing said discharge process, and subsequently said single driving motor is reversed to slightly rotate in a second direction so as make said displacement of said first plunger slightly increase from said minimum displacement thereby providing said pressure-rising process and simultaneously make said displacement of said second plunger slightly decrease from said maximum displacement thereby providing a pressure-dropping process, before said driving motor remains rotating in said second direction at variable speeds so as to make said displacement of said first plunger continuously increase up to a maximum displacement thereby providing said discharge process and simultaneously make said displacement of said second plunger continuously decrease to a minimum displacement thereby providing said suction process, and thereafter said single driving motor is reversed to slightly rotate again in said first direction so as to make said displacement of said first plunger slightly decrease from said maximum displacement thereby providing said pressure-dropping process and simultaneously make said displacement of said second plunger slightly increase from said minimum displacement thereby providing a pressure-rising process.

14. The pulsation free pump as claimed in claim 12, wherein said driving motor comprises a stepping motor, and wherein each of said first and second rotary-to-linear motion converters comprises:

a cylinder being mechanically connected to said plunger and capable of bi-directional linear motions along with said plunger, and said cylinder having a cyrindrically shaped inner wall formed thereon with first helical ball spline grooves receiving ball bearings; and a screw being mechanically connected through said transmission gear mechanism to said stepping motor and capable of bi-directional rotary motions, said screw having a cylindrical side face formed thereon with second helical ball spline grooves receiving said ball bearing; through which said screw is mechanically engaged with said cyrindrically shaped inner wall of said cylinder so that said bi-directional rotary motions of said screw are converted into said bi-directional linear motions of said cylinder.

15. The pulsation free pump as claimed in claim 12, wherein said driving motor comprises a stopping motor, and wherein each of said first and second rotary-to-linear motion converters comprises:

a cylinder being mechanically connected through said gear mechanism to said stepping motor and capable of bi-directional rotary motions along with said stepping motor, and said cylinder having a cyrindrically shaded inner wall formed thereon with first helical ball spline grooves receiving ball bearings; and a screw being mechanically connected to said plunger and capable of bi-directional linear motions, said screw having a cylindrical side face formed thereon with second helical ball spline grooves receiving said ball bearings through which said screw is mechanically engaged with said cyrindrically shaped inner wall of said cylinder so that said bi-directional rotary motions of said cylinder are converted into said bi-directional linear motions of said screw.

* * * * *